US011158226B2

(12) United States Patent
Feng et al.

(10) Patent No.: US 11,158,226 B2
(45) Date of Patent: Oct. 26, 2021

(54) GATE DRIVING UNIT AND METHOD, GATE DRIVING MODULE AND CIRCUIT AND DISPLAY DEVICE

(71) Applicants: HEFEI BOE JOINT TECHNOLOGY CO., LTD., Anhui (CN); BOE TECHNOLOGY GROUP CO., LTD., Beijing (CN)

(72) Inventors: Xuehuan Feng, Beijing (CN); Yongqian Li, Beijing (CN)

(73) Assignees: HEFEI BOE JOINT TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/768,536

(22) PCT Filed: Jan. 20, 2020

(86) PCT No.: PCT/CN2020/073141
§ 371 (c)(1),
(2) Date: May 29, 2020

(87) PCT Pub. No.: WO2020/181924
PCT Pub. Date: Sep. 17, 2020

(65) Prior Publication Data

US 2021/0209987 A1 Jul. 8, 2021

(30) Foreign Application Priority Data

Mar. 8, 2019 (CN) ..... 201910176221.7

(51) Int. Cl.
*G09G 3/20* (2006.01)

(52) U.S. Cl.
CPC ..... *G09G 3/20* (2013.01); *G09G 2300/0426* (2013.01); *G09G 2300/08* (2013.01);
(Continued)

(58) Field of Classification Search
CPC ..... G09G 2310/0286; G09G 3/3677; G09G 3/20; G09G 2310/0267; G09G 3/3648
See application file for complete search history.

(56) References Cited

U.S. PATENT DOCUMENTS

2010/0207928 A1 8/2010 Lee et al.
2013/0088480 A1* 4/2013 Hong ..... G09G 3/3688 345/212

(Continued)

FOREIGN PATENT DOCUMENTS

CN 103700406 A 4/2014
CN 104134416 A 11/2014

(Continued)

OTHER PUBLICATIONS

1st Chinese Office Action, English Translation.

(Continued)

*Primary Examiner* — Gerald Johnson
(74) *Attorney, Agent, or Firm* — Brooks Kushman P.C.

(57) ABSTRACT

The present disclosure provides a gate driving unit and method, a gate driving module and circuit, and a display device. The gate driving unit includes: an external compensation control signal output terminal, a gate driving signal output terminal, an external compensation control signal output circuit, a gate driving signal output circuit, a pull-up control circuit and a pull-down node control circuit. The pull-up control circuit is configured to, under control of an enabling signal input by an enabling terminal and a current-stage driving signal, control a potential at a first node; under control of the potential at the first node, a first clock signal input by a first clock signal terminal, a second clock signal input by a second clock signal terminal and a potential at a pull-down node, control a potential at a pull-up control node; under control of the potential at the pull-up control node, control a potential at a pull-up node, thereby controlling the (Continued)

potential at the pull-up node to be an effective voltage in a preset time period of a blank time period.

20 Claims, 11 Drawing Sheets

(52) U.S. Cl.
CPC ..... *G09G 2310/0267* (2013.01); *G09G 2310/061* (2013.01); *G09G 2310/08* (2013.01); *G09G 2320/0233* (2013.01)

(56) References Cited

U.S. PATENT DOCUMENTS

| | | | | |
|---|---|---|---|---|
| 2014/0085176 | A1 | 3/2014 | Kang | |
| 2014/0111413 | A1* | 4/2014 | Chen | G11C 19/28 345/100 |
| 2014/0321599 | A1 | 10/2014 | Cho et al. | |
| 2016/0049116 | A1* | 2/2016 | Cao | G09G 3/3266 345/213 |
| 2016/0247446 | A1 | 8/2016 | Cao et al. | |
| 2016/0284293 | A1 | 9/2016 | Dai | |
| 2016/0284294 | A1* | 9/2016 | Dai | H04N 13/359 |
| 2017/0011699 | A1* | 1/2017 | Wang | G11C 19/28 |
| 2017/0108989 | A1* | 4/2017 | Gu | G06F 3/04184 |
| 2018/0182299 | A1* | 6/2018 | Li | G09G 3/3266 |
| 2018/0204628 | A1 | 7/2018 | Gao et al. | |
| 2018/0286490 | A1 | 10/2018 | Sun et al. | |
| 2018/0350306 | A1* | 12/2018 | Zhang | G09G 3/3266 |
| 2019/0066604 | A1* | 2/2019 | Kong | G09G 3/3266 |
| 2019/0096500 | A1 | 3/2019 | Gu et al. | |
| 2019/0103049 | A1* | 4/2019 | Noh | H03K 17/162 |
| 2020/0066203 | A1* | 2/2020 | Kim | G09G 3/3266 |
| 2020/0167055 | A1 | 5/2020 | Du et al. | |
| 2020/0202779 | A1* | 6/2020 | Chang | G09G 3/3233 |
| 2020/0273503 | A1 | 8/2020 | Wang | |

FOREIGN PATENT DOCUMENTS

| | | | |
|---|---|---|---|
| CN | 104282270 | A | 1/2015 |
| CN | 105895047 | A | 8/2016 |
| CN | 106297634 | A | 1/2017 |
| CN | 106847160 | A | 6/2017 |
| CN | 107146568 | A | 9/2017 |
| CN | 107578741 | A | 1/2018 |
| CN | 108281123 | A | 7/2018 |
| CN | 108847174 | A | 11/2018 |
| CN | 109935188 | A | 6/2019 |
| KR | 20170105173 | A | 9/2017 |

OTHER PUBLICATIONS

International Search Report and Written Opinion, English Translation.
CN103700406A, English Abstract and U.S. Equivalent U.S. Pub. No. 2014/0085176.
CN104134416A, English Abstract and U.S. Equivalent U.S. Pub. No. 2014/0321599.
CN104282270A, English Abstract and U.S. Equivalent U.S. Pub. No. 2016/0247446.
CN105895047A, English Abstract and U.S. Equivalent U.S. Pub. No. 2018/0204628.
CN106297634A, English Abstract and Machine Translation.
CN106847160A, English Abstract and U.S. Equivalent U.S. Pub. No. 2018/0286490.
CN107146568A, English Abstract and U.S. Equivalent U.S. Pub. No. 2020/0167055.
CN107578741A, English Abstract and U.S. Equivalent U.S. Pub. No. 2019/0096500.
CN108281123A, English Abstract and U.S. Equivalent U.S. Pub. No. 2020/0273503.
CN108847174A, English Abstract and Machine Translation.
CN109935188A, English Abstract and Machine Translation.
KR20170105173A, English Abstract and Machine Translation.
First Office Action for Chinese Application No. 201910176221.7, dated Apr. 26, 2020, 6 Pages.
International Search Report and Written Opinion for Application No. PCT/CN2020/073141, dated Apr. 10, 2020, 12 Pages.

* cited by examiner

GATE DRIVING UNIT AND METHOD, GATE DRIVING MODULE AND CIRCUIT AND DISPLAY DEVICE

CROSS-REFERENCE TO RELATED APPLICATIONS

This application is the U.S. national phase of PCT Application No. PCT/CN2020/073141 filed on Jan. 20, 2020, which claims priority to Chinese Patent Application No. 201910176221.7 filed on Mar. 8, 2019, which are incorporated herein by reference in their entireties.

TECHNICAL FIELD

The present disclosure relates to the field of display driving technologies, and in particular to a gate driving unit and method, a gate driving module and circuit, and a display device.

BACKGROUND

In the related art, a gate driving unit applied to a pixel circuit having an external compensation function is generally composed of three sub-circuits, including a gate driving sub-circuit for generating a gate driving signal, a detection signal generation sub-circuit for generating a detection signal (in a blank period, a potential at the detection signal is an effective voltage; and in a display period, the detection signal is an ineffective voltage), and a sub-circuit for outputting a composite pulse signal (which is an external compensation control signal) of the gate driving signal and the detection signal. The structure of such circuit is very complex, which cannot meet requirements of high resolution and narrow border. Meanwhile, the gate driving unit in the related art is sequentially scanned and compensated, however, long-term sequential compensation will bring sweep lines in the blank periods (when performing external compensation on the gate driving unit of a certain stage, if a potential at the external compensation control signal is an effective voltage in a blank period, one row of pixel circuits displays black or white; if the compensation is performed sequentially, it will bring a sweep line). Further, in the gate driving unit in the related art, during the blank periods, a potential at a pull-up node cannot be sufficiently raised, which may result in abnormal output.

SUMMARY

One embodiment of the present disclosure provides a gate driving unit including: an external compensation control signal output terminal, a gate driving signal output terminal, an external compensation control signal output circuit, a gate driving signal output circuit, a pull-up control circuit and a pull-down node control circuit;

wherein the pull-up control circuit is configured to, under control of an enabling signal input by an enabling terminal and a current-stage driving signal, control a potential at a first node; under control of the potential at the first node, a first clock signal input by a first clock signal terminal, a second clock signal input by a second clock signal terminal and a potential at a pull-down node, control a potential at a pull-up control node; under control of the potential at the pull-up control node, control a potential at a pull-up node, thereby controlling the potential at the pull-up node to be an effective voltage in a preset time period of a blank time period;

the pull-down node control circuit is configured to control the potential at the pull-down node;

the external compensation control signal output circuit is configured to, under control of the potential at the pull-up node, control the external compensation control signal output terminal to be coupled with an external compensation clock signal terminal; under control of the potential at the pull-down node, control the external compensation control signal output terminal to be coupled with a first voltage terminal;

the gate driving signal output circuit is configured to, under control of the potential at the pull-up node and the potential at the pull-down node, control the gate driving signal output terminal to output a gate driving signal.

In implementation, waveform of the current-stage driving signal is the same as waveform of the gate driving signal.

In implementation, the pull-up control circuit includes a first node control sub-circuit, a second node control sub-circuit, a third node control sub-circuit, a pull-up control node control sub-circuit and a pull-up control sub-circuit;

the first node control sub-circuit is configured to, under control of the enabling signal, control the first node to receive the current-stage driving signal, and control to maintain the potential at the first node;

the second node control sub-circuit is configured to, under control of the second clock signal, control a potential at a second node;

the third node control sub-circuit is configured to, under control of the potential at the second node, control a third node to be coupled with a second voltage terminal;

the pull-up control node control sub-circuit is configured to, under control of the potential at the first node, control the pull-up control node to be coupled with the first clock signal terminal; and, under control of the potential at the pull-down node, control the pull-up control node to be coupled with the third node;

the pull-up control sub-circuit is configured to, under control of the potential at the pull-up control node, control the pull-up node to be coupled with a third voltage terminal.

In implementation, the second node control sub-circuit is further configured to, under control of the first clock signal, control the second node to be coupled with the second voltage terminal.

In implementation, the first node control sub-circuit includes a first control transistor and a storage capacitor;

a control electrode of the first control transistor is coupled with the enabling terminal; a first electrode of the first control transistor receives the current-stage driving signal; a second electrode of the first control transistor is coupled with the first node;

a first terminal of the storage capacitor is coupled with the first node; a second terminal of the storage capacitor is coupled with the pull-up control node.

In implementation, the second node control sub-circuit includes a second control transistor; a control electrode of the second control transistor and a first electrode of the second control transistor are coupled with the second clock signal terminal; a second electrode of the second control transistor is coupled with the second node.

In implementation, the second node control sub-circuit further includes a second node reset transistor; a control electrode of the second node reset transistor is coupled with the first clock signal terminal; a first electrode of the second node reset transistor is coupled with the second node; a second electrode of the second node reset transistor is coupled with the second voltage terminal.

In implementation, the third node control sub-circuit includes a third control transistor;

a control electrode of the third control transistor is coupled with the second node; a first electrode of the third control transistor is coupled with the third node; a second electrode of the third control transistor is coupled with the second voltage terminal;

the pull-up control node control sub-circuit includes a fourth control transistor and a fifth control transistor;

a control electrode of the fourth control transistor is coupled with the first node; a first electrode of the fourth control transistor is coupled with the first clock signal terminal; a second electrode of the fourth control transistor is coupled with the pull-up control node;

a control electrode of the fifth control transistor is coupled with the pull-down node; a first electrode of the fifth control transistor is coupled with the pull-up control node; a second electrode of the fifth control transistor is coupled with the third node;

the pull-up control sub-circuit includes a pull-up control transistor;

a control electrode of the pull-up control transistor is coupled with the pull-up control node; a first electrode of the pull-up control transistor is coupled with the pull-up node; a second electrode of the pull-up control transistor is coupled with the third voltage terminal.

In implementation, the gate driving unit further includes a pull-up node control circuit; the pull-up node control circuit is coupled with an input terminal, a reset terminal, the pull-up node, the pull-down node, a blank period reset terminal, a third voltage terminal and a fourth voltage terminal, respectively; the pull-up node control circuit is configured to, under control of an input signal input by the input terminal, control the pull-up node to be coupled with the third voltage terminal; under control of a reset signal input by the reset terminal, control the pull-up node to be coupled with the fourth voltage terminal; under control of a blank period reset signal input by the blank period reset terminal, control the pull-up node to be coupled with the fourth voltage terminal; under control of the potential at the pull-down node, control the pull-up node to be coupled with the fourth voltage terminal, and maintain the potential at the pull-up node.

In implementation, the pull-up node control circuit includes a first pull-up node control transistor, a second pull-up node control transistor, a third pull-up node control transistor, a fourth pull-up node control transistor, a first storage capacitor and a second storage capacitor;

a control electrode of the first pull-up node control transistor is coupled with the input terminal; a first electrode of the first pull-up node control transistor is coupled with the third voltage terminal; a second electrode of the first pull-up node control transistor is coupled with the pull-up node;

a control electrode of the second pull-up node control transistor is coupled with the reset terminal; a first electrode of the second pull-up node control transistor is coupled with the pull-up node; a second electrode of the second pull-up node control transistor is coupled with the fourth voltage terminal;

a control electrode of the third pull-up node control transistor is coupled with the blank period reset terminal; a first electrode of the third pull-up node control transistor is coupled with the pull-up node; a second electrode of the third pull-up node control transistor is coupled with the fourth voltage terminal;

a control electrode of the fourth pull-up node control transistor is coupled with the pull-down node; a first electrode of the fourth pull-up node control transistor is coupled with the pull-up node; a second electrode of the fourth pull-up node control transistor is coupled with the fourth voltage terminal;

a first terminal of the first storage capacitor is coupled with the pull-up node; a second terminal of the first storage capacitor is coupled with the external compensation control signal output terminal;

a first terminal of the second storage capacitor is coupled with the pull-up node; a second terminal of the second storage capacitor is coupled with the gate driving signal output terminal.

In implementation, the pull-down node control circuit is coupled with a first control voltage terminal, the pull-up node, the pull-down node, the first node, the first clock signal terminal, the input terminal and a fifth voltage terminal, respectively; the pull-down node control circuit is configured to, under control of a first control voltage input by the first control voltage terminal and the potential at the pull-up node, control the potential at the pull-down node; under control of the potential at the first node and the first clock signal, control the pull-down node to be coupled with the fifth voltage terminal; under control of the input signal input by the input terminal, control the pull-down node to be coupled with the fifth voltage terminal.

In implementation, the pull-down node control circuit includes a first pull-down control transistor, a second pull-down control transistor, a third pull-down control transistor, a fourth pull-down control transistor and a fifth pull-down control transistor;

a control electrode of the first pull-down control transistor and a first electrode of the first pull-down control transistor are both coupled with the first control voltage terminal; a second electrode of the first pull-down control transistor is coupled with the pull-down node;

a control electrode of the second pull-down control transistor is coupled with the pull-up node; a first electrode of the second pull-down control transistor is coupled with the pull-down node; a second electrode of the second pull-down control transistor is coupled with the fifth voltage terminal;

a control electrode of the third pull-down control transistor is coupled with the first clock signal terminal; a first electrode of the third pull-down control transistor is coupled with the pull-down node;

a control electrode of the fourth pull-down control transistor is coupled with the first node; a first electrode of the fourth pull-down control transistor is coupled with a second electrode of the third pull-down control transistor; a second electrode of the fourth pull-down control transistor is coupled with the fifth voltage terminal;

a control electrode of the fifth pull-down control transistor is coupled with the input terminal; a first electrode of the fifth pull-down control transistor is coupled with the pull-down node; a second electrode of the fifth pull-down control transistor is coupled with the fifth voltage terminal.

In implementation, the external compensation control signal output circuit includes a first compensation output transistor and a second compensation output transistor;

a control electrode of the first compensation output transistor is coupled with the pull-up node; a first electrode of the first compensation output transistor is coupled with the external compensation clock signal terminal; a second electrode of the first compensation output transistor is coupled with the external compensation control signal output terminal;

a control electrode of the second compensation output transistor is coupled with the pull-down node; a first electrode of the second compensation output transistor is coupled with the external compensation control signal output terminal; a second electrode of the second compensation output transistor is coupled with the first voltage terminal.

In implementation, the gate driving unit further includes a carry signal output terminal and a carry signal output circuit; the carry signal output circuit is configured to, under control of the potential at the pull-up node and the potential at the pull-down node, control the carry signal output terminal to output a carry signal; the current-stage driving signal is a carry signal provided by the carry signal output terminal.

One embodiment of the present disclosure provides a gate driving method, which is applied to the above gate driving unit, with a blank time period between two display periods, the gate driving method including:

in a display period, controlling, by the pull-up control circuit under control of an enabling signal input by the enabling terminal and a current-stage driving signal, a potential at the first node to be an effective voltage, and maintaining the potential at the first node to be the effective voltage; controlling, by the pull-up control circuit under control of the potential at the first node, a first clock signal input by the first clock signal terminal, a second clock signal input by the second clock signal terminal and a potential at the pull-down node, a potential at the pull-up control node to be an ineffective voltage;

in a preset time period of the blank time period after the display period, maintaining, by the pull-up control circuit, the potential at the first node to be the effective voltage; controlling, by the pull-up control circuit under control of the potential at the first node and the first clock signal, the potential at the pull-up control node; controlling, by the pull-up control circuit under control of the potential at the pull-up control node, a potential at the pull-up node to be an effective voltage; and, controlling, by the external compensation control signal output circuit under control of the potential at the pull-up node, the external compensation control signal output terminal to be coupled with the external compensation clock signal terminal.

In implementation, the pull-up control circuit includes a first node control sub-circuit, a second node control sub-circuit, a third node control sub-circuit, a pull-up control node control sub-circuit and a pull-up control sub-circuit; in the display period, the first clock signal terminal inputs an ineffective voltage, the second clock signal terminal inputs an effective voltage; the preset time period includes a clock input phase and an external compensation output phase which are sequentially set; the gate driving method includes:

in an output phase included in the display period, inputting, by the enabling terminal, an effective voltage, the current-stage driving signal being an effective voltage; controlling, by the first node control sub-circuit, the first node to receive the current-stage driving signal; controlling, by the pull-up control node control sub-circuit, the pull-up control node to be coupled with the first clock signal terminal; controlling, by the pull-up control sub-circuit, the pull-up node to be dis-coupled with a third voltage terminal;

in a reset phase and an output cut-off hold phase included in the display period, inputting, by the enabling terminal, an ineffective voltage, the potential at the pull-down node being an effective voltage; maintaining, by the first node control sub-circuit, the potential at the first node; controlling, by the second node control sub-circuit, the potential at the second node to be an effective voltage; controlling, by the third node control sub-circuit, a third node to be coupled with a second voltage terminal; controlling, by the pull-up control node control sub-circuit, the pull-up control node to be coupled with the first clock signal terminal, and controlling the pull-up control node to be coupled with the third node; controlling, by the pull-up control sub-circuit, the pull-up node to be dis-coupled with the third voltage terminal;

in the clock input phase and the external compensation output phase in the blank time period after the display period, maintaining, by the first node control sub-circuit, the potential at the first node;

wherein in the clock input phase, the first clock signal terminal inputs an effective voltage, the second clock signal input terminal inputs an ineffective voltage; the pull-up control node control sub-circuit controls the pull-up control node to be coupled with the first clock signal terminal; the pull-up control sub-circuit controls the pull-up node to be coupled with the third voltage terminal, thereby controlling the potential at the pull-up node to be an effective voltage;

wherein in the external compensation output phase, the first clock signal terminal inputs an effective voltage, the second clock signal terminal inputs an ineffective voltage; the first node control sub-circuit maintains the potential at the first node to be an effective voltage; the pull-up control node control sub-circuit controls the pull-up control node to be coupled with the first clock signal terminal; the pull-up control sub-circuit dis-couples the pull-up node from the third voltage terminal, thereby maintaining the potential at the pull-up node to be an effective voltage; the external compensation clock signal terminal inputs an effective voltage, and the external compensation control signal output circuit controls the external compensation control signal output terminal to be coupled with the external compensation clock signal terminal.

In implementation, the blank time period further includes a blank period reset phase after the preset time period; the gate driving method further includes: in the blank period reset phase, inputting, by the enabling terminal, an effective voltage, the current-stage driving signal being an ineffective voltage; controlling, by the first node control sub-circuit, the first node to receive the current-stage driving signal, thereby resetting the potential at the first node.

In implementation, the gate driving unit further includes a pull-up node control circuit; the gate driving method further includes: in the blank period reset phase, inputting, by the blank period reset terminal, an effective voltage to reset the potential at the pull-up node.

One embodiment of the present disclosure provides a gate driving module, including the above gate driving unit; wherein the gate driving unit is an N-th stage gate driving unit, N is a positive integer; the gate driving module further includes a (N+1)-th stage gate driving unit;

a pull-up node in the (N+1)-th stage gate driving unit is a (N+1)-th pull-up node; a pull-down node in the (N+1)-th gate driving unit is a (N+1)-th pull-down node; a pull-up control node in the (N+1)-th gate driving unit is a pull-up control node in the N-th stage gate driving unit;

the (N+1)-th gate driving unit includes a (N+1)-th stage pull-up control circuit, a (N+1)-th stage external compensation control signal output terminal, a (N+1)-th stage gate driving signal output terminal, a (N+1)-th stage external compensation control signal output circuit, a (N+1)-th stage gate driving signal output circuit, and a (N+1)-th stage pull-down node control circuit;

the (N+1)-th stage pull-up control circuit is coupled with the N-th pull-up control node, and is configured to, under control of a potential at the N-th pull-up control node, control the (N+1)-th pull-up node to be coupled with a third voltage terminal;

the (N+1)-th stage pull-down node control circuit is configured to control a potential at the (N+1)-th pull-down node;

the (N+1)-th stage external compensation control signal output circuit is configured to, under control of the potential at the (N+1)-th pull-up node, control the (N+1)-th stage external compensation control signal output terminal to be coupled with the second external compensation clock signal terminal; under control of the potential at the (N+1)-th pull-down node, control the external compensation control signal output terminal to be coupled with a first voltage terminal;

the (N+1)-th stage gate driving signal output circuit is configured to, under control of the potential at the (N+1)-th pull-up node and the potential at the (N+1)-th pull-down node, control the (N+1)-th stage gate driving signal output terminal to output a gate driving signal.

In implementation, the (N+1)-th stage gate driving unit further includes a (N+1)-th pull-up node control circuit;

the (N+1)-th pull-up node control circuit is coupled with an input terminal, a reset terminal, the (N+1)-th pull-up node, the (N+1)-th pull-down node, a blank period reset terminal, a third voltage terminal and a fourth voltage terminal, respectively; the (N+1)-th pull-up node control circuit is configured to, under control of an input signal input by the input terminal, control the (N+1)-th pull-up node to be coupled with the third voltage terminal; under control of a reset signal input by the reset terminal, control the (N+1)-th pull-up node to be coupled with the fourth voltage terminal; under control of a blank period reset signal input by the blank period reset terminal, control the (N+1)-th pull-up node to be coupled with the fourth voltage terminal; under control of the potential at the (N+1)-th pull-down node, control the (N+1)-th pull-up node to be coupled with the fourth voltage terminal, and maintain the potential at the (N+1)-th pull-up node.

In implementation, the pull-up control circuit in the N-th stage gate driving unit is an N-th pull-up control circuit; the N-th pull-up control circuit includes a first node control sub-circuit, a second node control sub-circuit, a third node control sub-circuit, a pull-up control node control sub-circuit and a pull-up control sub-circuit;

the (N+1)-th pull-down node control circuit is coupled with a second control voltage terminal, the (N+1)-th pull-up node, the (N+1)-th pull-down node, the first node in the N-th stage gate driving unit, the first clock signal terminal, the reset terminal and a fifth voltage terminal, respectively; the (N+1)-th pull-down node control circuit is configured to, under control of a second control voltage input by the second control voltage terminal and the potential at the (N+1)-th pull-up node, control a potential at the (N+1)-th pull-down node; under control of the potential at the first node and a first clock signal input by the first clock signal terminal, control the (N+1)-th pull-down node to be coupled with the fifth voltage terminal; under control of the input signal input by the input terminal, control the pull-down node to be coupled with the fifth voltage terminal.

In implementation, the external compensation control signal output circuit in the N-th stage gate driving unit is an N-th external compensation control signal output circuit; the gate driving signal output circuit in the N-th stage gate driving unit is the N-th gate driving signal output circuit; the external compensation control signal output terminal in the N-th stage gate driving unit is an N-th stage external compensation control signal output terminal; the gate driving signal output terminal in the N-th stage gate driving unit is the N-th stage gate driving signal output terminal; the pull-up node in the N-th stage gate driving unit is an N-th pull-up node; the pull-down node in the N-th stage gate driving unit is an N-th pull-down node;

the N-th external compensation control signal output circuit is further coupled with the (N+1)-th pull-down node, and is configured to, under control of a potential at the (N+1)-th pull-down node, reset the N-th external compensation control signal output terminal;

the N-th gate driving signal output circuit is further coupled with the (N+1)-th pull-down node, and is configured to, under control of a potential at the (N+1)-th pull-down node, reset the N-th gate driving signal output terminal;

the (N+1)-th external compensation control signal output circuit is further coupled with the N-th pull-down node, and is configured to, under control of a potential at the N-th pull-down node, reset the (N+1)-th stage external compensation control signal output terminal;

the (N+1)-th gate driving signal output circuit is further coupled with the N-th pull-down node, and is configured to, under control of the potential at the N-th pull-down node, reset the (N+1)-th stage gate driving signal output terminal.

One embodiment of the present disclosure provides a gate driving circuit including a plurality of stages of the above gate driving modules.

In implementation, an n-th stage gate driving module includes an N-th stage gate driving unit and a (N+1)-th stage gate driving unit; in the n-th stage gate driving module, an input terminal is coupled with a (N−2)-th stage gate driving signal output terminal, and a reset terminal is coupled with a (N+4)-th stage gate driving signal output terminal, wherein n is a positive integer.

In implementation, the N-th stage gate driving unit includes a carry signal output terminal and a carry signal output circuit; the n-th stage gate driving module includes an N-th stage gate driving unit and a (N+1)-th stage gate driving unit; in the n-th stage gate driving module, an input terminal is coupled with a (N−2)-th stage carry signal output terminal, and a reset terminal is coupled with a (N+4)-th stage carry signal output terminal, wherein n is a positive integer.

DETAILED DESCRIPTION

The technical solutions in the embodiments of the present disclosure will be described hereinafter in a clear and complete manner in conjunction with the drawings of the embodiments. Obviously, the following embodiments are merely a part of, rather than all of, the embodiments of the present disclosure, and based on these embodiments, a person skilled in the art may obtain the other embodiments, which also fall within the scope of the present disclosure.

Transistors used in all embodiments of the present disclosure may each be a triode, a thin film transistor, a field effect transistor or other device having same characteristics. In the embodiments of the present disclosure, in order to distinguish two electrodes of the transistor in addition to a control electrode, one of the two electrodes is referred to as a first electrode, and the other electrode is referred to as a second electrode.

In actual operation, when the transistor is a triode, the control electrode may be a base, the first electrode may be a collector, and the second electrode may be an emitter; or the control electrode may be a base, the first electrode may be an emitter and the second electrode may be a collector.

In actual operation, when the transistor is a thin film transistor or a field effect transistor, the control electrode may be a gate electrode, the first electrode may be a drain electrode, and the second electrode may be a source electrode; or the control electrode may be a gate electrode, the first electrode may be a source electrode, and the second electrode may be a drain electrode.

Figure 1:
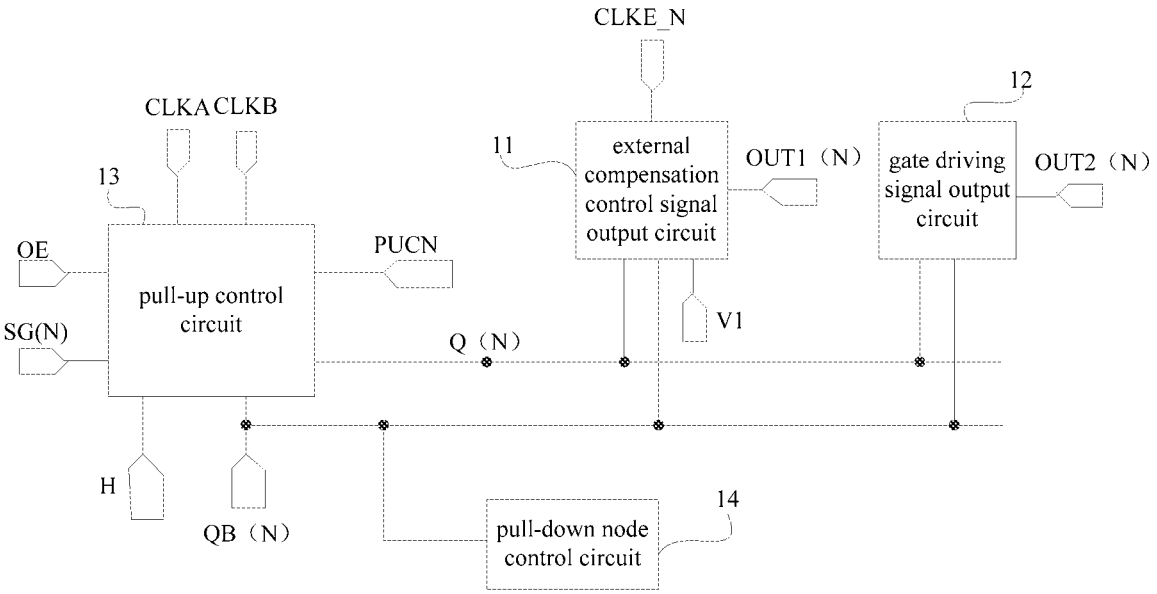
FIG. 1 is a block diagram of a gate driving unit according to an embodiment of the present disclosure.

As shown in FIG. 1, a gate driving unit according to an embodiment of the present disclosure includes an external compensation control signal output terminal OUT1(N), a gate driving signal output terminal OUT2(N), an external compensation control signal output circuit 11, a gate driving signal output circuit 12, a pull-up control circuit 13, and a pull-down node control circuit 14.

The pull-up control circuit 13 is coupled to an enabling terminal OE, a first clock signal terminal, a second clock signal terminal, a pull-up node Q(N), a pull-down node QB(N), a first node H, and a pull-up control node PUCN, respectively. The pull-up control circuit is configured to, control a potential at the first node H under control of an enabling signal input by the enabling terminal OE and a driving signal of the current stage; control a potential at the pull-up control node PUCN under control of the potential at the first node H, a first clock signal CLKA input by the first clock signal terminal, a second clock signal CLKB input by the second clock signal terminal and a potential at the pull-down node QB(N); and control a potential at pull-up node Q(N) under control of the potential at the pull-up control node PUCN, thereby controlling the potential at the pull-up node Q(N) to be an effective voltage during a preset time period in a blank time period.

The pull-down node control circuit 14 is configured to control the potential at the pull-down node QB(N).

The external compensation control signal output circuit 11 is configured to, control the external compensation control signal output terminal OUT1(N) to be coupled with an external compensation clock signal terminal under control of the potential at the pull-up node Q(N); and control the external compensation control signal output terminal OUT1(N) to be coupled with a first voltage terminal under control of the potential at the pull-down node QB(N). The external compensation clock signal terminal is configured to input an external compensation clock signal CLKE_N. The first voltage terminal is configured to input a first voltage V1.

The gate driving signal output circuit 12 is configured to, under control of the potential at the pull-up node Q(N) and the potential at the pull-down node QB(N), control the gate driving signal output terminal OUT2(N) to output a gate driving signal.

In a specific implementation, the first voltage terminal may be a low voltage terminal, but is not limited thereto.

In a specific implementation, the effective voltage is a voltage that enables a transistor with its gate electrode receiving the voltage to turn on. For example, when the transistor is an n-type transistor, the effective voltage may be a high voltage; when the transistor is a p-type transistor, the effective voltage may be a low voltage, which is not limited to this.

In a specific implementation, the effective voltage is a voltage that enables a transistor with its gate electrode receiving the voltage to turn off. For example, when the transistor is an n-type transistor, the effective voltage may be a low voltage; when the transistor is a p-type transistor, the effective voltage may be a high voltage, which is not limited to this.

When the gate driving unit shown in FIG. 1 according to an embodiment of the present disclosure is in operation, there is a blank time period between two display periods. The gate driving method includes:

in the display period, controlling, by the pull-up control circuit 13 under control of an enabling signal input by the enabling terminal OE and a driving signal SG(N) of the current stage, a potential at the first node H to be an effective voltage, and maintaining the potential at the first node H to be the effective voltage; controlling, by the pull-up control circuit 13 under control of the potential at the first node H, a first clock signal CLKA input by the first clock signal terminal, a second clock signal CLKB input by the second clock signal terminal and a potential at the pull-down node QB(N), a potential at the pull-up control node PUCN to be an ineffective voltage;

in a preset time period of a blank time period after the display period, maintaining, by the pull-up control circuit 13, the potential at the first node H to be the effective voltage; controlling, by the pull-up control circuit 13 under control of the potential at the first node H and the first clock signal CLKA input by the first clock signal terminal, the potential at the pull-up control node PUCN; controlling, by the pull-up control circuit 13 under control of the potential at the pull-up control node PUCN, a potential at the pull-up node Q(N) to be an effective voltage; and, controlling, by the external compensation control signal output circuit 11 under control of the potential at the pull-up node Q(N), the external compensation control signal output terminal OUT1(N) to be coupled with the external compensation clock signal terminal.

The gate driving unit in one embodiment of the present disclosure can simultaneously output the gate driving signal and the external compensation control signal to simultaneously provide the gate driving signal and the external compensation signal for a pixel circuit with the external compensation function, thereby simplifying the structure of the circuit. Meanwhile, random compensation can be performed by employing the gate driving unit in the embodiment of the present disclosure, and then sweep lines and brightness deviation of a panel can be eliminated by employing the random compensation.

In actual operation, the display period may include an input phase, an output phase, a reset phase, and an output cut-off hold phase, which are sequentially set. In the input phase and the output phase, the potential at the PU(N) is an effective voltage. In the output phase, each of the gate driving signal output terminal and the external compensation control signal output terminal outputs an effective voltage. In the reset phase and the output cut-off hold phase, each of the gate driving signal output terminal and the external compensation control signal output terminal outputs an ineffective voltage.

In actual operation, it is assumed that the gate driving unit in one embodiment of the present disclosure provides a corresponding gate driving signal for an N-th row (N is a positive integer) gate line in a display panel, then the gate driving unit in one embodiment of the present disclosure is an N-th stage gate driving unit included in a gate driving circuit, and the current stage refers to the N-th stage.

In a specific implementation, waveform of the current stage driving signal SG(N) is the same as waveform of the gate driving signal.

According to a specific embodiment, the current stage driving signal SG(N) may be provided by the gate driving signal output terminal OUT2(N).

According to another embodiment, when the gate driving unit in one embodiment of the present disclosure includes a carry-signal output circuit and a carry-signal output terminal, the current stage driving signal SG(N) may be provided by the carry-signal output terminal.

Figure 2:
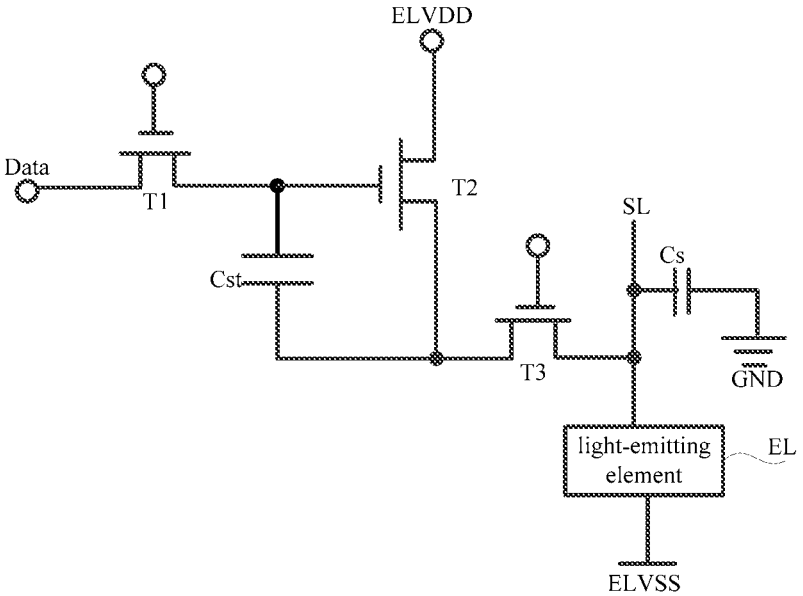
FIG. 2 is a circuit diagram of a pixel circuit having an external compensation function.

As shown in FIG. 2, a pixel circuit with external compensation function may include a data writing transistor T1, a capacitor Cst, a driving transistor T2, a light emitting element EL, and an external compensation control transistor T3. A gate electrode of T1 is coupled with a corresponding stage gate driving signal output terminal. A gate electrode of T3 is coupled with a corresponding stage external compensation control signal output terminal. In FIG. 2, a data line is labeled with Data, high level is labeled with ELVDD, low level is labeled with ELVSS, an external compensation line is labeled with SL, a ground terminal is labeled with GND, and parasitic capacitance on the external compensation line SL is labeled with Cs.

Specifically, the pull-up control circuit may include a first node control sub-circuit, a second node control sub-circuit, a third node control sub-circuit, a pull-up control node control sub-circuit and a pull-up control sub-circuit.

The first node control sub-circuit is configured to, under control of the enabling signal, control the first node to receive a current-stage driving signal, and control to maintain a potential at the first node.

The second node control sub-circuit is configured to, under control of a second clock signal, control a potential at the second node.

The third node control sub-circuit is configured to, under control of the potential at the second node, control a third node to be coupled with a second voltage terminal.

The pull-up control node control sub-circuit is configured to, under control of the potential at the first node, control the pull-up control node to be coupled with the first clock signal terminal; and, under control of the potential at the pull-down node, control the pull-up control node to be coupled with the third node.

The pull-up control sub-circuit is configured to, under control of the potential at the pull-up control node, control the pull-up node to be coupled with the third voltage terminal.

In a specific implementation, the second voltage terminal may be a first low voltage terminal, and the third voltage terminal may be a high voltage terminal, but is not limited thereto.

Figure 3:
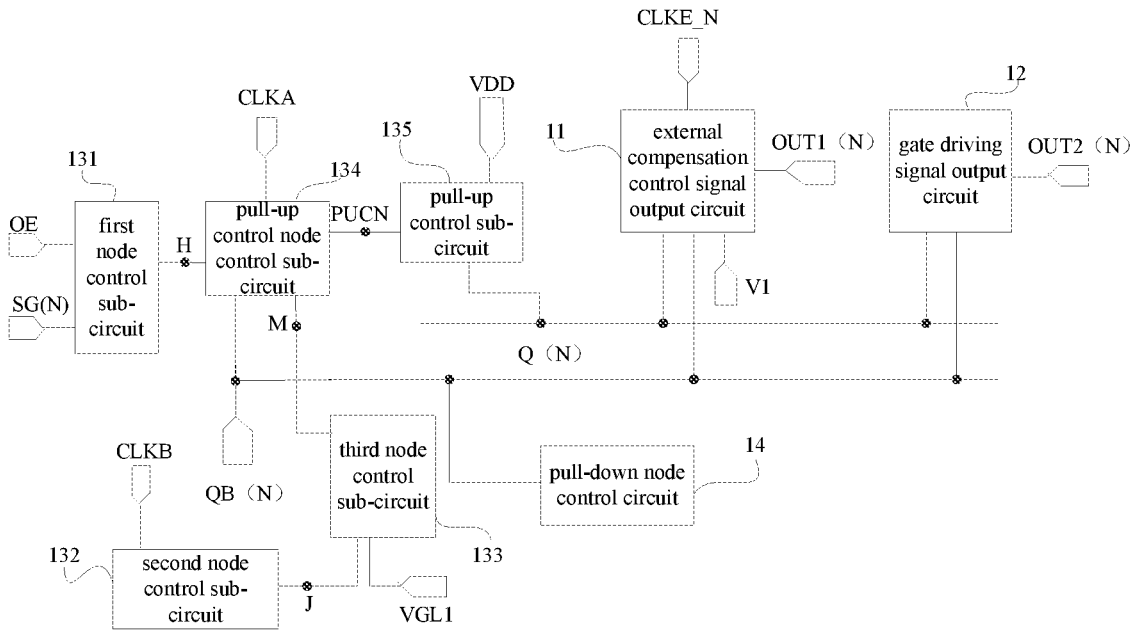
FIG. 3 is a block diagram of a gate driving unit according to another embodiment of the present disclosure.

As shown in FIG. 3, on the basis of the gate driving unit shown in FIG. 1 according to an embodiment of the present disclosure, the pull-up control circuit includes a first node control sub-circuit 131, a second node control sub-circuit 132, a third node control sub-circuit 133, a pull-up control node control sub-circuit 134 and a pull-up control sub-circuit 135.

The first node control sub-circuit 131 is coupled with the enabling terminal OE and a first node H, respectively. The first node control sub-circuit is configured to, under control of an enabling signal input by the enabling terminal OE, control the first node H to receive the current stage driving signal SG(N) and control to maintain a potential at the first node H.

The second node control sub-circuit 132 is coupled with a second node J and a second clock signal terminal, respectively. The second node control sub-circuit is configured to, under control of the second clock signal CLKB, control a potential at the second node J.

The third node control sub-circuit 133 is coupled with the second node J, a third node M and the first low voltage terminal, respectively. The third node control sub-circuit is configured to, under control of the potential at the second node J, control the third node M to be coupled with the first low voltage terminal. The first low voltage terminal is used to input a first low voltage VGL1.

The pull-up control node control sub-circuit 134 is coupled with the pull-up control node PUCN, the first node H, the first clock signal terminal, the pull-down node QB(N), and the third node M, respectively. The pull-up control node control sub-circuit is configured to, under control of the potential at the first node H, control the pull-up control node PUCN to be coupled with the first clock signal terminal; and under control of the potential at the pull-down node QB(N), control the pull-up control node PUCN to be coupled with the third node M.

The pull-up control sub-circuit 135 is coupled with the pull-up control node PUCN, the pull-up node Q(N) and the high voltage terminal, respectively. The pull-up control sub-circuit is configured to, under control of the potential at the pull-up control node PUCN, control the pull-up node Q(N) to be coupled with the high voltage terminal. The high voltage terminal is used to input a high voltage VDD.

In the embodiment shown in FIG. 3, the second voltage terminal is a first low voltage terminal, and the third voltage terminal is a high voltage terminal, but is not limited thereto.

When the pull-up control circuit shown in FIG. 3 is in operation, the preset time period in the blank time period includes a clock input phase and an external compensation output phase, which are sequentially set. The gate driving method includes:

in an output phase included in a display period, inputting, by the enabling terminal OE, an effective voltage; controlling, by the first node control sub-circuit 131, the first node H to receive a current-stage driving signal SG(N) which is an effective voltage; controlling, by the pull-up control node control sub-circuit 134, the pull-up control node PUCN to receive CLKA; controlling, by the pull-up control sub-circuit 135, the pull-up node Q(N) to not receive a high voltage VDD;

in a reset phase and an output cut-off hold phase included in the display period, inputting, by the enabling terminal OE, an ineffective voltage, the potential at the pull-down node QB(N) being an effective voltage; maintaining, by the first node control sub-circuit 131, the potential at the first node H; controlling, by the second node control sub-circuit 132, the potential at the second node J to be an effective voltage; controlling, by the third node control sub-circuit 133, the third node M to receive a first low voltage VGL1; controlling, by the pull-up control node control sub-circuit 134, the pull-up control node PUCN to receive CLKA, and controlling the pull-up control node PUCN to be coupled with the third node M; controlling, by the pull-up control sub-circuit 135, the pull-up node Q(N) to be dis-coupled with the voltage terminal;

in the clock input phase and the external compensation output phase in a blank time period after the display period, maintaining, by the first node control sub-circuit 131, the potential at the first node H;

where in the clock input phase, the first clock signal CLKA is an effective voltage, the second clock signal CLKB is an ineffective voltage; the pull-up control node control sub-circuit 134 controls the pull-up control node PUCN to receive the first clock signal CLKA; the pull-up control sub-circuit 135 controls the pull-up node Q(N) to receive the high voltage VDD, thereby controlling the potential at the pull-up node Q(N) to be an effective voltage;

where in the external compensation output phase, the first clock signal CLKA is an effective voltage, the second clock signal CLKB is an ineffective voltage; the first node control sub-circuit 131 maintains the potential at the first node H to be an effective voltage; the pull-up control node control sub-circuit 134 controls the pull-up control node PUCN to receive the first clock signal CLKA; the pull-up control sub-circuit 135 dis-couples the pull-up node Q(N) from the high voltage terminal, thereby maintaining the potential at the pull-up node Q(N) to be an effective voltage; an external compensation clock signal CLKE_N input by the external compensation clock signal terminal is an effective voltage, and the external compensation control signal output circuit 11 controls the external compensation control signal output terminal OUT1(N) to be coupled with the external compensation clock signal terminal.

In a specific implementation, the second node control sub-circuit is further configured to, under control of the first clock signal, control the second node to be coupled with the second voltage terminal.

When the first clock signal is an effective voltage, the second node control sub-circuit controls the second node to be coupled with the second voltage terminal. When the first clock signal is an ineffective voltage, the second node control sub-circuit controls the second node to not be coupled with the second voltage terminal.

Specifically, the first node control sub-circuit may include a first control transistor and a storage capacitor.

A control electrode of the first control transistor is coupled with the enabling terminal. A first electrode of the first control transistor receives the current-stage driving signal. A second electrode of the first control transistor is coupled with the first node.

A first terminal of the storage capacitor is coupled with the first node. A second terminal of the storage capacitor is coupled with the pull-up control node.

Specifically, the second node control sub-circuit may include a second control transistor.

Both of a control electrode and a first electrode of the second control transistor are coupled with the second clock signal terminal. A second electrode of the second control transistor is coupled with the second node.

Specifically, the second node control sub-circuit may further include a second node reset transistor.

A control electrode of the second node reset transistor is coupled with the first clock signal terminal. A first electrode of the second node reset transistor is coupled with the second node. A second electrode of the second node reset transistor is coupled with the second voltage terminal.

Specifically, the third node control sub-circuit may include a third control transistor.

A control electrode of the third control transistor is coupled with the second node. A first electrode of the third control transistor is coupled with the third node. A second electrode of the third control transistor is coupled with the second voltage terminal.

The pull-up control node control sub-circuit includes a fourth control transistor and a fifth control transistor.

A control electrode of the fourth control transistor is coupled with the first node. A first electrode of the fourth control transistor is coupled with the first clock signal terminal. A second electrode of the fourth control transistor is coupled with the pull-up control node.

A control electrode of the fifth control transistor is coupled with the pull-down node. A first electrode of the fifth control transistor is coupled with the pull-up control node. A second electrode of the fifth control transistor is coupled with the third node.

The pull-up control sub-circuit includes a pull-up control transistor.

A control electrode of the pull-up control transistor is coupled with the pull-up control node. A first electrode of the pull-up control transistor is coupled with the pull-up node. A second electrode of the pull-up control transistor is coupled with a third voltage terminal.

Figure 4:
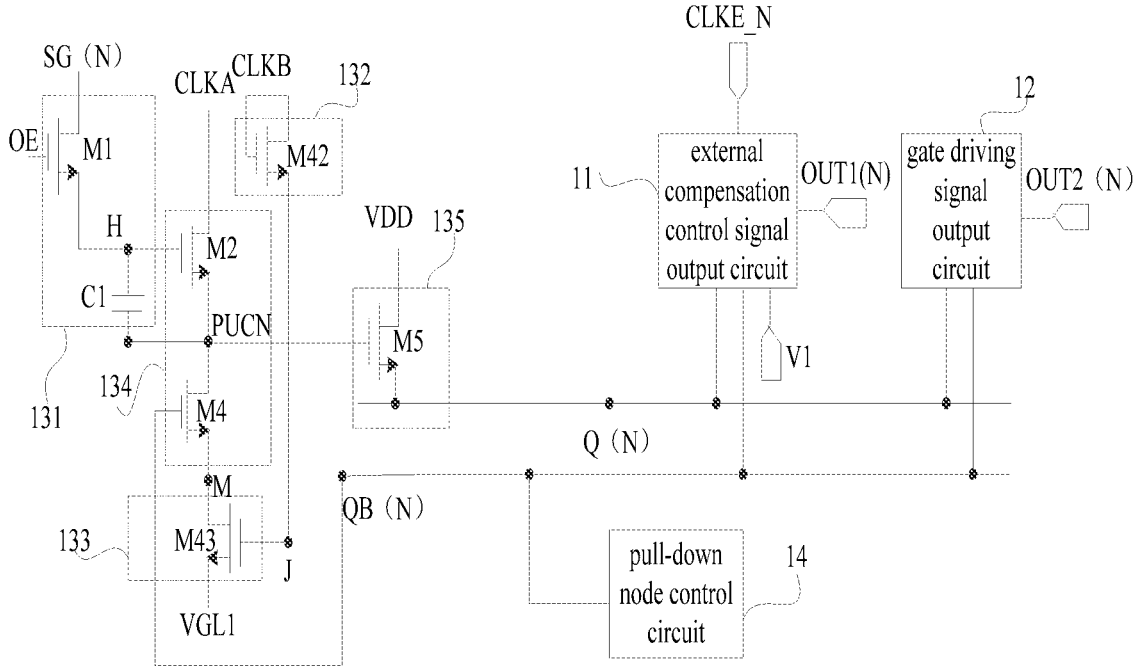
FIG. 4 is a block diagram of a gate driving unit according to a still another embodiment of the present disclosure.

As shown in FIG. 4, on the basis of the gate driving unit shown in FIG. 3 according to an embodiment of the present disclosure, the first node control sub-circuit 131 includes a first control transistor M1 and a storage capacitor C1.

A gate electrode of the first control transistor M1 receives an enabling signal input by the enabling terminal OE. A drain electrode of the first control transistor M1 receives the current-stage driving signal SG(N). A source electrode of the first control transistor M1 is coupled with the first node H.

A first terminal of the storage capacitor C1 is coupled with the first node H. A second terminal of the storage capacitor C1 is coupled with the pull-up control node PUCN.

The second node control sub-circuit 132 includes a second control transistor M42.

Both of a gate electrode and a drain electrode of the second control transistor M42 receive the second clock signal CLKB. A source electrode of the second control transistor M42 is coupled with the second node J.

The third node control sub-circuit 133 includes a third control transistor M43.

A gate electrode of the third control transistor M43 is coupled with the second node J. A drain electrode of the third control transistor M43 is coupled with the third node M. A source electrode of the third control transistor M43 receives the first low voltage VGL1.

The pull-up control node control sub-circuit 134 includes a fourth control transistor M2 and a fifth control transistor M4.

A gate electrode of the fourth control transistor M2 is coupled with the first node. A drain electrode of the fourth control transistor M2 receives the first clock signal CLKA. A source electrode of the fourth control transistor M2 is coupled with the pull-up control node PUCN.

A gate electrode of the fifth control transistor M4 is coupled with the pull-down node QB(N). A drain electrode of the fifth control transistor M4 is coupled with the pull-up control node PUCN. A source electrode of the fifth control transistor M4 is coupled with the third node M.

The pull-up control sub-circuit 135 includes a pull-up control transistor M5.

A gate electrode of the pull-up control transistor M5 is coupled with the pull-up control node PUCN. A drain electrode of the pull-up control transistor M5 is coupled with the pull-up node Q(N). A source electrode of the pull-up control transistor M5 receives a high voltage VDD.

In the gate driving unit according to one embodiment of the present disclosure, the first node control sub-circuit 131 includes the storage capacitor C1 for preventing the potential at the pull-up control node PUCN from decreasing due to leakage during the clock input phase in the blank time period (during which, CLKA is high voltage, CLKB is low voltage, the potential at QB(N) is low voltage, M2 is turned on, M42 and M4 are turned off), so that the potential at the first node H rises due to second bootstrap of C1, the pull-up control node PUCN obtains a lossless high potential of CLKA, Q(N) receives VDD, thereby increasing the potential at Q(N) and then ensuring the potential at Q(N) is high voltage and enhancing circuit reliability.

The new circuit structure can increase the potential at the pull-up node and enhance circuit reliability.

In the embodiment shown in FIG. 4, all of the transistors are n-type thin film transistors, but not limited thereto. The second voltage terminal is the first low voltage terminal, the third voltage terminal is the high voltage terminal. The effective voltage is high voltage, the ineffective voltage is low voltage, but not limited to this.

When the gate driving unit shown in FIG. 4 according to an embodiment of the present disclosure is in operation, if it is required to control the OUT1(N) to output an effective voltage during a blank time period after a display period, then, in the output phase of the display period, OE inputs a high voltage, SG(N) is a high voltage, M1 is turned on to control the potential at the first node H to be a high voltage; C1 maintains the potential at the first node H to be the high voltage; CLKA is a low voltage and CLKB is a high voltage, M2 is turned on so that PUCN receives CLKA and the potential at PUCN is low voltage, M5 is turned off to not affect the display; M42 is turned on so that the potential at the second node J is high voltage, M43 is turned on so that third node M receives VGL1; at this time, the potential at QB(N) is a low voltage, then M4 is turned off;

in the reset phase and output cut-off hold phase of the display period, the OE input a low voltage, M1 is turned off, C1 maintains the potential at the second node J to be a high voltage, CLKA is a low voltage, M2 is turned on; CLKB is a high voltage, M42 is turned on so that the potential at the first node is a high voltage, M43 is turned on, M receives VGL1, and the potential at QB(N) is high voltage, M4 is turned on to control the third node M to be coupled with PUCN, the potential at PUCN is low voltage, and M5 is turned off to not affect the display;

in the clock input phase of the blank time period, CLKA is a high voltage, CLKB is a low voltage, the potential at QB(N) is a low voltage, M2 is turned on, M42 and M4 are turned off to prevent the potential at the pull-up control node PUCN from decreasing due to leakage, so that the potential at the first node H rises due to the secondary bootstrap, the pull-up control node PUCN obtains the lossless high potential of CLKA, and Q(N) receives VDD and then the potential at Q(N) is a high voltage;

in the external compensation output phase of the blank time period, CLKA is a low voltage, CLKB is a high voltage, the potential at the first node H is maintained at the high voltage, M2 is turned on to pull low the potential at PUCN, M5 is turned off, the potential at Q(N) maintained to be the high voltage by a storage capacitor (which includes a first storage capacitor disposed between Q(N) and OUT1(N) and a second storage capacitor disposed between Q(N) and OUT2(N)); at this time, CLKE_N is a high voltage, CLKF_N is a low voltage, OUT1(N) outputs a high voltage, and OUT2(N) outputs a low voltage.

In a specific implementation, the blank time period further includes a blank period reset phase after the external compensation output phase.

In the blank period reset phase, the enabling terminal OE inputs a high voltage, SG(N) is a low voltage, M1 is turned on, and the potential at the first node H is a low voltage, thereby resetting the potential at the first node H.

When the gate driving unit shown in FIG. 4 according to an embodiment of the present disclosure is in operation, during the display period, M42 and M43 have no effect on the display. In the clock input phase of the blank time period, CLKA is high potential, high potential needs to be written to the pull-up node Q(n) of a sense row, and CLKB is also changed to low potential, thereby preventing the potential at the pull-up control node PUCN from decreasing due to leakage, so that the potential at the first node H rises due to the secondary bootstrap, the pull-up control node PUCN obtains a lossless high potential of CLKA, and high potential is written to Q(N).

When the gate driving unit shown in FIG. 4 according to an embodiment of the present disclosure is in operation, it is assumed that the gate driving unit is coupled with a gate line in an N-th row (N is a positive integer) in a display panel, the N-th row is a sense row. That is, in a blank time period, it is necessary to provide an external compensation control signal for an N-th row pixel circuit (the N-th row pixel circuit is a pixel circuit having an external compensation function) on the display panel. Further, in a display period, when scanning to the gate line in the N-th, it is necessary to control OE to input an effective voltage to set the potential at the first node H to be an effective voltage. Further, the potential at the first node H is maintained to be the effective voltage in the display period and the preset time period of the blank time period. In the clock input phase of the blank time period, CLKA is an effective voltage, then the potential at the pull-up control node PUCN is set to be an effective voltage, thereby controlling the potential at Q(N) to be an effective voltage. The potential at Q(N) is maintained to be an effective voltage in the external compensation output phase of the blank time period. In the external compensation output phase, CLKE_N is an effective voltage, then OUT1(N) outputs an effective voltage, CLKF_N is an ineffective voltage and OUT2(N) outputs an ineffective voltage.

Specifically, the second node control sub-circuit may further include a second node reset transistor.

A control electrode of the second node reset transistor is coupled with the first clock signal terminal. A first electrode of the second node reset transistor is coupled with the second node. A second electrode of the second node reset transistor is coupled with the second voltage terminal.

When the first clock signal terminal inputs an effective voltage, the second node reset transistor is turned on to enable the second node to receive the second voltage. When the first clock signal terminal inputs an ineffective voltage, the second node reset transistor is turned off.

In a specific implementation, the gate driving unit in one embodiment of the present disclosure may further include a pull-up node control circuit.

The pull-up node control circuit is coupled with the input terminal, the reset terminal, the pull-up node, the pull-down node, a blank period reset terminal, a third voltage terminal and a fourth voltage terminal, respectively. The pull-up node control circuit is configured to, under control of an input signal input by the input terminal, control the pull-up node to be coupled with the third voltage terminal; under control of a reset signal input by the reset terminal, control the pull-up node to be coupled with the fourth voltage terminal; under control of a blank period reset signal input by the blank period reset terminal, control the pull-up node to be coupled with the fourth voltage terminal; under control of the potential at the pull-down node, control the pull-up node to be coupled with the fourth voltage terminal, and maintain the potential at the pull-up node.

The third voltage terminal may be a high voltage terminal, and the fourth voltage terminal may be a first low voltage terminal, but is not limited thereto.

Figure 5:
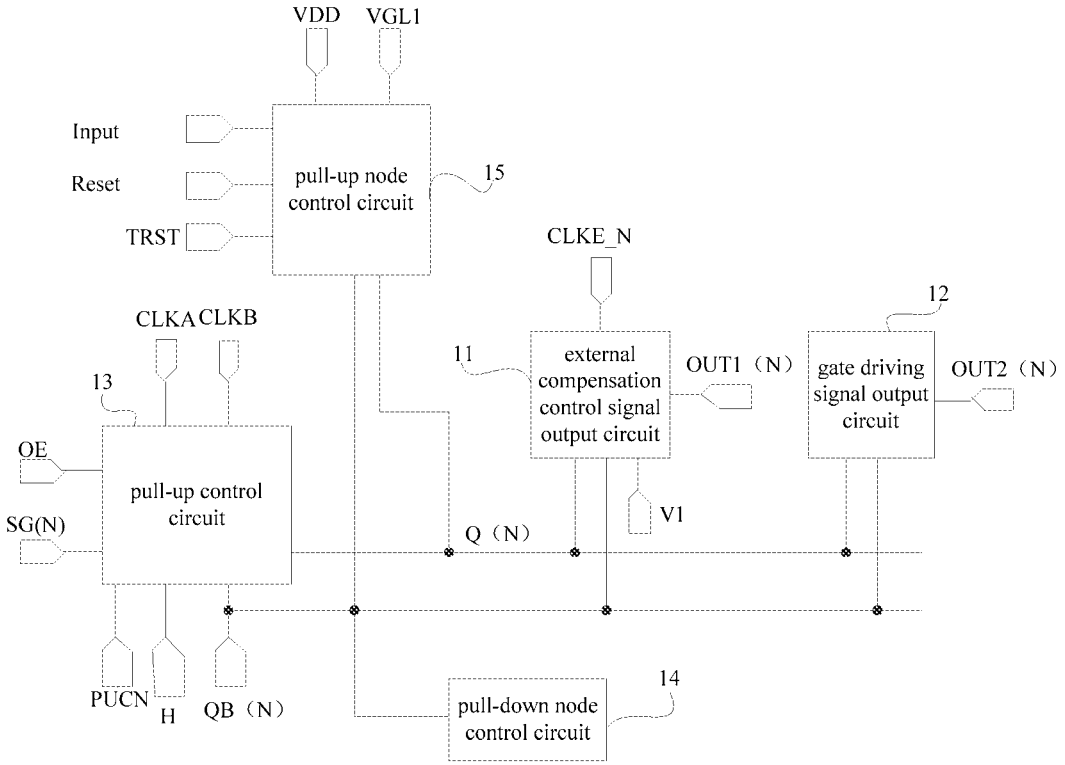
FIG. 5 is a block diagram of a gate driving unit according to a yet another embodiment of the present disclosure.

As shown in FIG. 5, on the basis of the gate driving unit shown in FIG. 1 according to an embodiment of the present disclosure, the gate driving unit according to one embodiment of the present disclosure may further include a pull-up node control circuit 15.

The pull-up node control circuit 15 is coupled with an input terminal Input, a reset terminal Reset, the pull-up node Q(N), the pull-down node QB(N), a blank period reset terminal TRST, a high voltage terminal and a first low voltage terminal, respectively. The pull-up node control circuit is configured to, under control of an input signal input by the input terminal Input, control the pull-up node Q(N) to be coupled with the high voltage terminal; under control of a reset signal input at the reset terminal Reset, control the pull-up node Q(N) to be coupled with the first low voltage terminal; under control of a blank period reset signal input by the blank period reset terminal TRST, control the pull-up node Q(N) to be coupled with the first low voltage terminal; under control of the potential at the pull-down node QB(N), control the pull-up node Q(N) to be coupled with the first low voltage terminal, and maintain the potential at the pull-up node Q(N).

In a specific implementation, in a blank period reset phase of the blank time period, the blank period reset signal input by TRST is an effective voltage; under control of the blank period reset signal input by TRST, the pull-up node control circuit 15 controls the pull-up node Q(N) to receive a first low voltage VGL1, thereby resetting the potential at the pull-up node Q(N).

In an input phase included in the display period, the input signal input by the input terminal Input is a high voltage, and the pull-up node control circuit 15 controls the pull-up node Q(N) to receive a high voltage VDD to pull up the potential at the pull-up node Q(N).

In a reset phase included in the display period, the reset signal input by the reset terminal Reset is a high voltage, and the pull-up node control circuit 15 controls the pull-up node Q(N) to receive VGL1.

In an output cut-off phase included in the display period, the potential at the pull-down node QB(N) is a high voltage, and the pull-up node control circuit 15 controls the pull-up node Q(N) to receive VGL1.

Specifically, the pull-up node control circuit may include a first pull-up node control transistor, a second pull-up node control transistor, a third pull-up node control transistor, a fourth pull-up node control transistor, a first storage capacitor and a second storage capacitor.

A control electrode of the first pull-up node control transistor is coupled with the input terminal. A first electrode of the first pull-up node control transistor is coupled with the third voltage terminal. A second electrode of the first pull-up node control transistor is coupled with the pull-up node.

A control electrode of the second pull-up node control transistor is coupled with the reset terminal. A first electrode of the second pull-up node control transistor is coupled with the pull-up node. A second electrode of the second pull-up node control transistor is coupled with the fourth voltage terminal.

A control electrode of the third pull-up node control transistor is coupled with the blank period reset terminal. A first electrode of the third pull-up node control transistor is coupled with the pull-up node. A second electrode of the third pull-up node control transistor is coupled with the fourth voltage terminal.

A control electrode of the fourth pull-up node control transistor is coupled with the pull-down node. A first electrode of the fourth pull-up node control transistor is coupled with the pull-up node. A second electrode of the fourth pull-up node control transistor is coupled with the fourth voltage terminal.

A first terminal of the first storage capacitor is coupled with the pull-up node. A second terminal of the first storage capacitor is coupled with the external compensation control signal output terminal.

A first terminal of the second storage capacitor is coupled with the pull-up node. A second terminal of the second storage capacitor is coupled with the gate driving signal output terminal.

In a specific implementation, the pull-down node control circuit may be coupled with a first control voltage terminal, the pull-up node, the pull-down node, the first node, the first clock signal terminal, the input terminal and a fifth voltage terminal, respectively. The pull-down node control circuit is configured to, under control of a first control voltage input by the first control voltage terminal and the potential at the pull-up node, control the potential at the pull-down node; under control of the potential at the first node and the first clock signal, control the pull-down node to be coupled with the fifth voltage terminal; under control of the input signal input by the input terminal, control the pull-down node to be coupled with the fifth voltage terminal.

In a specific implementation, the fifth voltage terminal may be the first low voltage terminal, but is not limited thereto.

Figure 6:
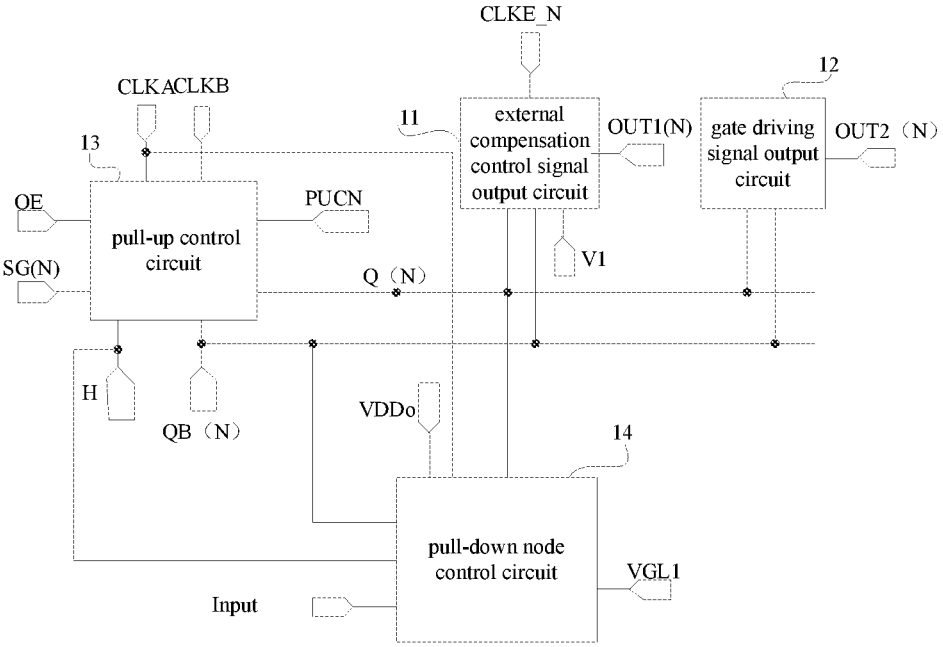
FIG. 6 is a block diagram of a gate driving unit according to a still yet another embodiment of the present disclosure.

As shown in FIG. 6, on the basis of the gate driving unit shown in FIG. 1 according to an embodiment of the present disclosure, the pull-down node control circuit 14 is coupled with a first control voltage terminal, the pull-up node Q(N), the pull-down node QB(N), the first node H, the first clock signal terminal, the input terminal Input and a first low voltage terminal, respectively. The pull-down node control circuit is configured to, under control of a first control voltage VDDo input by the first control voltage terminal and the potential at the pull-up node Q(N), control the potential at the pull-down node QB(N); under control of the potential at the first node H and the first clock signal CLKA, control the pull-down node QB(N) to receive the first low voltage VGL1; and under control of the input signal input by the input terminal Input, control the pull-down node QB(N) to receive the first low voltage VGL.

When the gate driving unit shown in FIG. 6 according to an embodiment of the present disclosure is in operation, in a display period, the first control voltage VDDo may be an effective voltage.

When the gate driving unit shown in FIG. 6 according to an embodiment of the present disclosure is in operation, in a display period, the first control voltage VDDo is an effective voltage, when the potential at the pull-up node Q(N) is an effective voltage, the pull-down node control circuit 14 controls the potential at the pull-down node QB(N) to be an ineffective voltage. When the input terminal Input inputs an effective voltage, the pull-down node QB(N) receives VGL.

In a clock input phase of the blank time period, the potential at the first node H is an effective voltage, and CLKA is an effective voltage, and the pull-down node control circuit 14 controls the pull-down node QB(N) to receive VGL.

Specifically, the pull-down node control circuit may include a first pull-down control transistor, a second pull-down control transistor, a third pull-down control transistor, a fourth pull-down control transistor and a fifth pull-down control transistor.

A control electrode of the first pull-down control transistor and a first electrode of the first pull-down control transistor are both coupled with the first control voltage terminal. A second electrode of the first pull-down control transistor is coupled with the pull-down node.

A control electrode of the second pull-down control transistor is coupled with the pull-up node. A first electrode of the second pull-down control transistor is coupled with the pull-down node. A second electrode of the second pull-down control transistor is coupled with the fifth voltage terminal.

A control electrode of the third pull-down control transistor is coupled with the first clock signal terminal. A first electrode of the third pull-down control transistor is coupled with the pull-down node.

A control electrode of the fourth pull-down control transistor is coupled with the first node. A first electrode of the fourth pull-down control transistor is coupled with a second electrode of the third pull-down control transistor. A second electrode of the fourth pull-down control transistor is coupled with the fifth voltage terminal.

A control electrode of the fifth pull-down control transistor is coupled with the input terminal. A first electrode of the fifth pull-down control transistor is coupled with the pull-down node. A second electrode of the fifth pull-down control transistor is coupled with the fifth voltage terminal.

In a specific implementation, the fifth voltage terminal may be the first low voltage terminal, but is not limited thereto.

Figure 7:
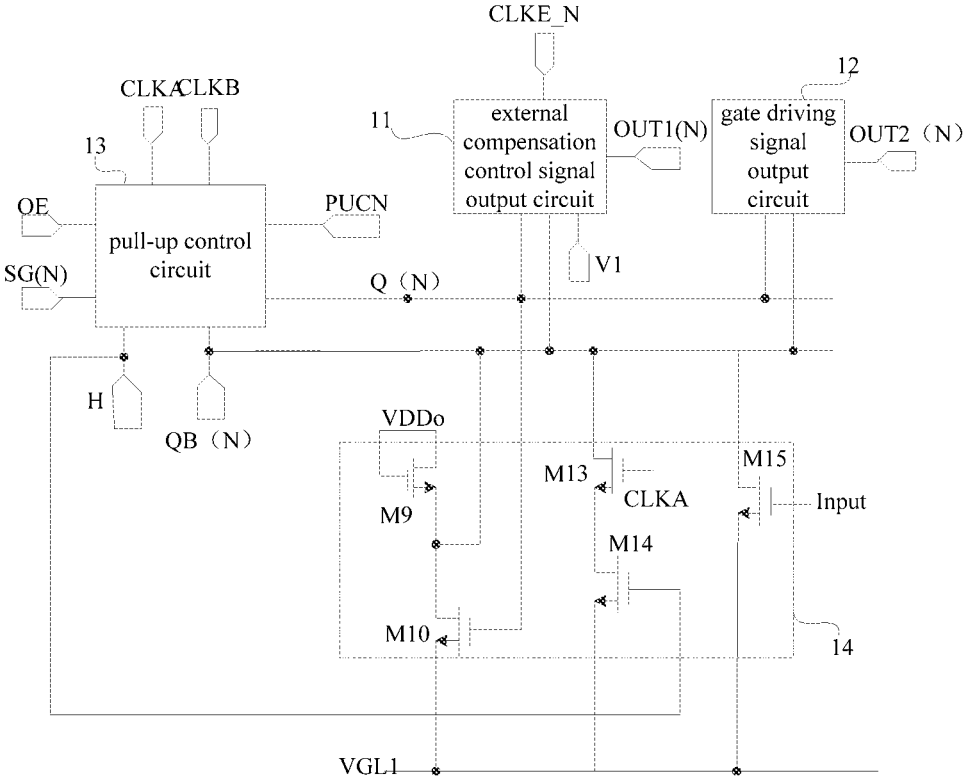
FIG. 7 is a block diagram of a gate driving unit according to a still yet another embodiment of the present disclosure.

As shown in FIG. 7, on the basis of the gate driving unit shown in FIG. 6 according to an embodiment of the present disclosure, the pull-down node control circuit 14 includes a first pull-down control transistor M9, a second pull-down control transistor M10, a third pull-down control transistor M13, a fourth pull-down control transistor M14 and a fifth pull-down control transistor M15.

A gate electrode of the first pull-down control transistor M9 and a drain electrode of the first pull-down control transistor M9 are both coupled with the first control voltage terminal. A source electrode of the first pull-down control transistor M9 is coupled with the pull-down node QB(N). The first control voltage terminal is configured to input the first control voltage VDDo.

A gate electrode of the second pull-down control transistor M10 is coupled with the pull-up node Q(N). A drain electrode of the second pull-down control transistor M10 is coupled with the pull-down node QB(N). A source electrode of the second pull-down control transistor M10 receives the first low voltage VGL1.

A gate electrode of the third pull-down control transistor M13 receives the first clock signal CLKA. A drain electrode of the third pull-down control transistor M13 is coupled with the pull-down node QB(N).

A gate electrode of the fourth pull-down control transistor M14 is coupled with the first node H. A drain electrode of the fourth pull-down control transistor M14 is coupled with a source electrode of the third pull-down control transistor M13. A source electrode of the fourth pull-down control transistor M14 receives the first low voltage VGL1.

A gate electrode of the fifth pull-down control transistor M15 is coupled with the input terminal Input. A drain electrode of the fifth pull-down control transistor M15 is coupled with the pull-down node QB(N). A source electrode of the fifth pull-down control transistor M15 receives the first low voltage VGL1.

In the embodiment shown in FIG. 7, all of the transistors are n-type thin film transistors, but are not limited thereto.

When the gate driving unit shown in FIG. 7 according to an embodiment of the present disclosure is in operation, in a display period, the first control voltage VDDo may be an effective voltage, and M9 is turned on.

In an input phase and an output phase included in the display period, the potential at the pull-up node Q(N) is a high voltage, and M10 is turned on to pull down the potential at the pull-down node QB(N).

In an input phase included in the display period, the input terminal Input inputs a high voltage, M15 is turned on to control the pull-down node QB(N) to receive VGL1.

In a clock input phase included in the blank time period, the potential at the first node H is high voltage, CLKA is high voltage, M13 and M14 are both turned on to control the pull-down node QB(N) to receive VGL1, thereby pulling down the voltage of the pull-down node QB(N).

Specifically, the external compensation control signal output circuit may include a first compensation output transistor and a second compensation output transistor.

A control electrode of the first compensation output transistor is coupled with the pull-up node. A first electrode of the first compensation output transistor is coupled with the external compensation clock signal terminal. A second electrode of the first compensation output transistor is coupled with the external compensation control signal output terminal.

A control electrode of the second compensation output transistor is coupled with the pull-down node. A first electrode of the second compensation output transistor is coupled with the external compensation control signal output terminal. A second electrode of the second compensation output transistor is coupled with the first voltage terminal.

In a specific implementation, the gate driving signal output circuit may further include a first gate driving signal output transistor and a second gate driving signal output transistor.

A control electrode of the first gate driving signal output transistor is coupled with the pull-up node. A first electrode of the first gate driving signal output transistor is coupled with a gate driving output clock signal terminal. A second electrode of the first gate driving signal output transistor is coupled with the gate driving signal output terminal.

A control electrode of the second gate driving signal output transistor is coupled with the pull-down node. A first electrode of the second gate driving signal output transistor is coupled with the gate driving signal output terminal. A second electrode of the second gate driving signal output transistor is coupled with the first voltage terminal.

Optionally, the gate driving unit according to one embodiment of the present disclosure may further include a carry signal output terminal and a carry signal output circuit.

The carry signal output circuit is configured to, under control of the potential at the pull-up node and the potential at the pull-down node, control the carry signal output terminal to output a carry signal.

The current-stage driving signal is a carry signal provided by the carry signal output terminal.

In the embodiment of the present disclosure, the carry signal output terminal is configured to provide an input signal for an input terminal of an adjacent lower-stage gate driving unit, and provide a reset signal for a reset terminal of an adjacent upper-stage gate driving unit, to enhance driving capability of the gate driving signal output terminal. At this point, the current-stage driving signal may be a carry signal provided by the carry signal output terminal.

Figure 8:
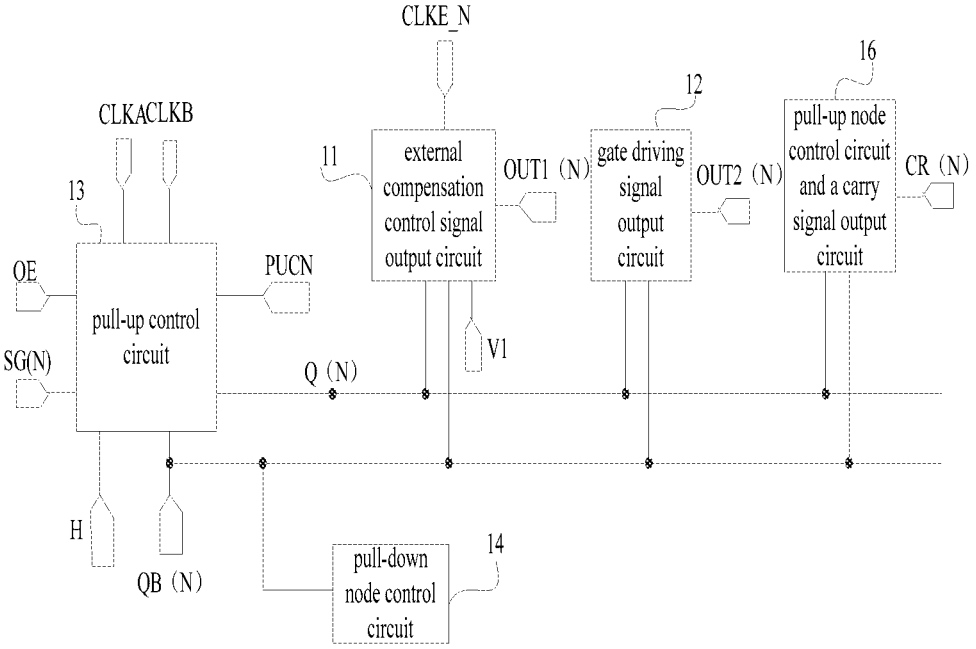
FIG. 8 is a block diagram of a gate driving unit according to a still yet another embodiment of the present disclosure.

As shown in FIG. 8, on the basis of the gate driving unit shown in FIG. 1 according to an embodiment of the present disclosure, the gate driving unit according to an embodiment of the present disclosure may further include a carry signal output terminal CR(N) and a carry signal output circuit 16.

The carry signal output circuit 16 is coupled with the pull-up node Q(N), the pull-down node QB(N) and the carry signal output terminal CR(N), respectively. The carry signal output circuit is configured to, under control of the potential at the pull-up node Q(N) and the potential at the pull-down node QB(N), control the carry signal output terminal CR(N) to output a carry signal.

The pull-up control circuit 13 is coupled with the carry signal output terminal CR(N). The carry signal output terminal CR(N) is configured to provide the current-stage driving signal to the pull-up control circuit 13.

Specifically, the carry signal output circuit may include a first carry signal output transistor and a second carry signal output transistor.

A control electrode of the first carry signal output transistor is coupled with the pull-up node. A first electrode of the first carry signal output transistor is coupled with a carry output clock signal terminal. A second electrode of the first carry signal output transistor is coupled with the carry signal output terminal.

A control electrode of the second carry signal output transistor is coupled with the pull-down node. A first electrode of the second carry signal output transistor is coupled with the carry signal output terminal. A second electrode of the second carry signal output transistor is coupled with the second voltage terminal.

In a specific implementation, the carry output clock signal input by the carry output clock signal terminal and the gate driving output clock signal input by the gate driving output clock signal terminal may be the same, but not limited thereto.

The gate driving unit of the present disclosure will be described hereinafter with a specific embodiment.

Figure 9A:
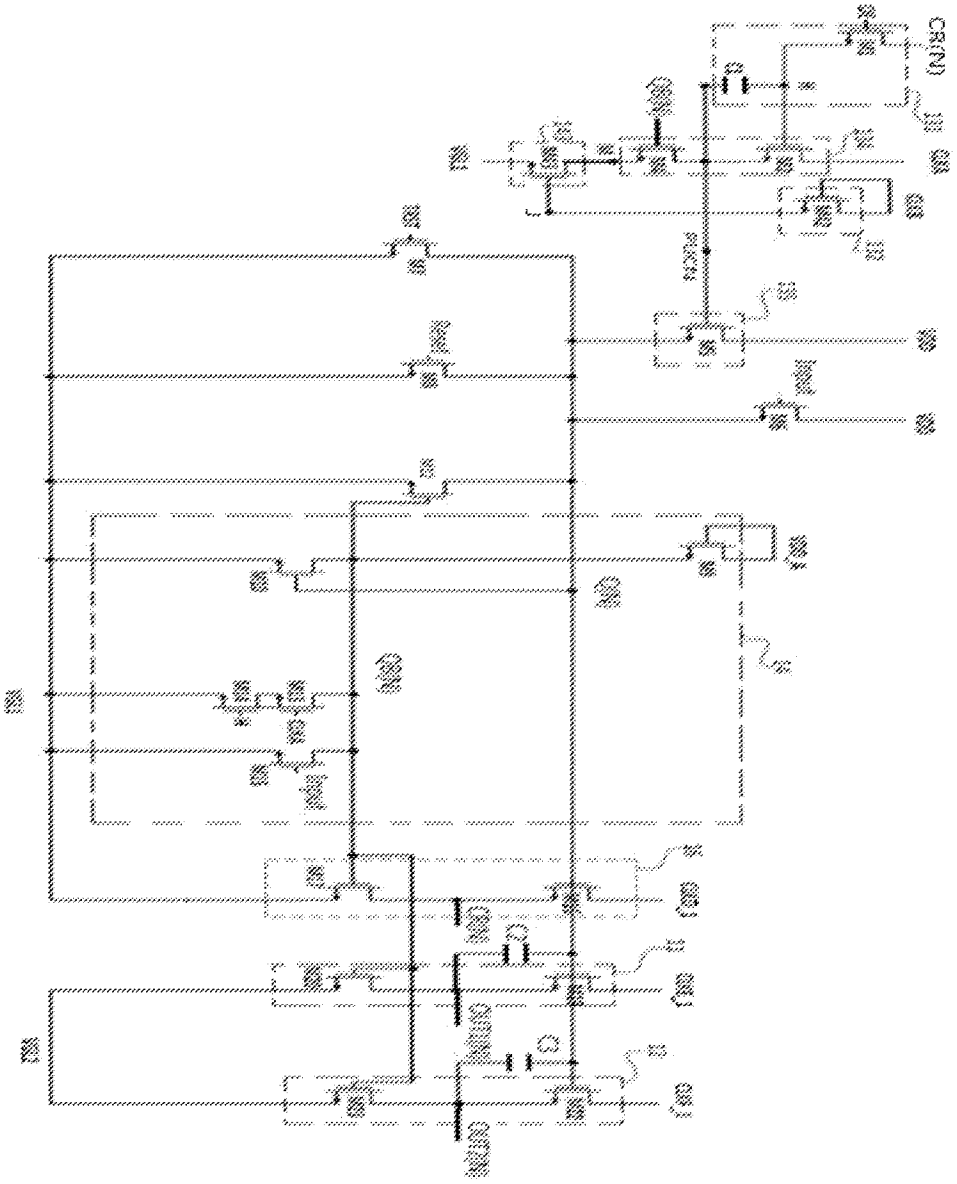
FIG. 9A is a circuit diagram of a gate driving unit according to an embodiment of the present disclosure.

As shown in FIG. 9A, a gate driving unit according to an embodiment of the present disclosure includes an external compensation control signal output terminal OUT1(N), a gate driving signal output terminal OUT2(N), a carry signal output terminal CR(N), an external compensation control signal output circuit 11, a gate driving signal output circuit 12, a pull-up control circuit 13, a pull-down node control circuit 14, a pull-up node control circuit and a carry signal output circuit 16.

The pull-up control circuit includes a first node control sub-circuit 131, a second node control sub-circuit 132, a third node control sub-circuit 133, a pull-up control node control sub-circuit 134 and a pull-up control sub-circuit 135.

The first node control sub-circuit 131 includes a first control transistor M1 and a storage capacitor C1.

A gate electrode of the first control transistor M1 receives an enabling signal input by the enabling terminal OE. A drain electrode of the first control transistor M1 is coupled with the carry signal output terminal CR(N). A source electrode of the first control transistor M1 is coupled with the first node H.

A first terminal of the storage capacitor C1 is coupled with the first node H. A second terminal of the storage capacitor C1 is coupled with the pull-up control node PUCN.

The second node control sub-circuit 132 includes a second control transistor M42.

Both of a gate electrode and a drain electrode of the second control transistor M42 receive the second clock signal CLKB. A source electrode of the second control transistor M42 is coupled with the second node J.

The third node control sub-circuit 133 includes a third control transistor M43.

A gate electrode of the third control transistor M43 is coupled with the second node J. A drain electrode of the third control transistor M43 is coupled with the third node M. A source electrode of the third control transistor M43 receives the first low voltage VGL1.

The pull-up control node control sub-circuit 134 includes a fourth control transistor M2 and a fifth control transistor M4.

A gate electrode of the fourth control transistor M2 is coupled with the first node H. A drain electrode of the fourth control transistor M2 receives the first clock signal CLKA. A source electrode of the fourth control transistor M2 is coupled with the pull-up control node PUCN.

A gate electrode of the fifth control transistor M4 is coupled with the pull-down node QB(N). A drain electrode of the fifth control transistor M4 is coupled with the pull-up control node PUCN. A source electrode of the fifth control transistor M4 is coupled with the third node M.

The pull-up control sub-circuit 135 includes a pull-up control transistor M5.

A gate electrode of the pull-up control transistor M5 is coupled with the pull-up control node PUCN. A drain electrode of the pull-up control transistor M5 is coupled with the pull-up node Q(N). A source electrode of the pull-up control transistor M5 receives a high voltage VDD.

The pull-up node control circuit includes a first pull-up node control transistor M6, a second pull-up node control transistor M8, a third pull-up node control transistor M7, a fourth pull-up node control transistor M12, a first storage capacitor C2 and a second storage capacitor C3.

A gate electrode of the first pull-up node control transistor M6 is coupled with the input terminal Input. A drain electrode of the first pull-up node control transistor M6 receives a high voltage VDD. A source electrode of the first pull-up node control transistor M6 is coupled with the pull-up node Q(N).

A gate electrode of the second pull-up node control transistor M8 is coupled with the reset terminal Reset. A drain electrode of the second pull-up node control transistor M8 is coupled with the pull-up node Q(N). A source electrode of the second pull-up node control transistor M8 receives VGL1.

A gate electrode of the third pull-up node control transistor M7 is coupled with the blank period reset terminal TRST. A drain electrode of the third pull-up node control transistor M7 is coupled with the pull-up node Q(N). A source electrode of the third pull-up node control transistor M7 receives VGL1.

A gate electrode of the fourth pull-up node control transistor M12 is coupled with the pull-down node QB(N). A drain electrode of the fourth pull-up node control transistor M12 is coupled with the pull-up node Q(N). A source electrode of the fourth pull-up node control transistor M12 receives VGL1.

A first terminal of the first storage capacitor C2 is coupled with the pull-up node Q(N). A second terminal of the first storage capacitor C2 is coupled with the external compensation control signal output terminal OUT1(N).

A first terminal of the second storage capacitor C3 is coupled with the pull-up node Q(N). A second terminal of the second storage capacitor C3 is coupled with the gate driving signal output terminal OUT2(N).

The pull-down node control circuit 14 includes a first pull-down control transistor M9, a second pull-down control transistor M10, a third pull-down control transistor M13, a fourth pull-down control transistor M14 and a fifth pull-down control transistor M15.

A gate electrode of the first pull-down control transistor M9 and a drain electrode of the first pull-down control transistor M9 are both coupled with the first control voltage terminal. A source electrode of the first pull-down control transistor M9 is coupled with the pull-down node QB(N). The first control voltage terminal is configured to input the first control voltage VDDo.

A gate electrode of the second pull-down control transistor M10 is coupled with the pull-up node Q(N). A drain electrode of the second pull-down control transistor M10 is coupled with the pull-down node QB(N). A source electrode of the second pull-down control transistor M10 receives the first low voltage VGL1.

A gate electrode of the third pull-down control transistor M13 receives the first clock signal CLKA. A drain electrode of the third pull-down control transistor M13 is coupled with the pull-down node QB(N).

A gate electrode of the fourth pull-down control transistor M14 is coupled with the first node H. A drain electrode of the fourth pull-down control transistor M14 is coupled with a source electrode of the third pull-down control transistor M13. A source electrode of the fourth pull-down control transistor M14 receives the first low voltage VGL1.

A gate electrode of the fifth pull-down control transistor M15 is coupled with the input terminal Input. A drain electrode of the fifth pull-down control transistor M15 is coupled with the pull-down node QB(N). A source electrode of the fifth pull-down control transistor M15 receives the first low voltage VGL1.

The external compensation control signal output circuit 11 includes a first compensation output transistor M19 and a second compensation output transistor M20.

A gate electrode of the first compensation output transistor M19 is coupled with the pull-up node Q(N). A drain electrode of the first compensation output transistor M19 receives an external compensation clock signal CLKE_N. A source electrode of the first compensation output transistor M19 is coupled with the external compensation control signal output terminal OUT1(N).

A gate electrode of the second compensation output transistor M20 is coupled with the pull-down node QB(N). A drain electrode of the second compensation output transistor M20 is coupled with the external compensation control signal output terminal OUT1(N). A source electrode of the second compensation output transistor M20 receives the second low voltage VGL2.

The gate driving signal output circuit 12 includes a first gate driving signal output transistor M22 and a second gate driving signal output transistor M23.

A gate electrode of the first gate driving signal output transistor M22 is coupled with the pull-up node Q(N). A drain electrode of the first gate driving signal output transistor M22 receives an external compensation clock signal CLKE_N. A source electrode of the first gate driving signal output transistor M22 is coupled with the gate driving signal output terminal OUT2(N).

A gate electrode of the second gate driving signal output transistor M23 is coupled with the pull-down node QB(N). A drain electrode of the second gate driving signal output transistor M23 is coupled with the gate driving signal output terminal OUT2(N). A source electrode of the second gate driving signal output transistor M23 receives the second low voltage VGL2.

The carry signal output circuit 16 includes a first carry signal output transistor M16 and a second carry signal output transistor M17.

A gate electrode of the first carry signal output transistor M16 is coupled with the pull-up node Q(N). A drain electrode of the first carry signal output transistor M16 receives a carry output clock signal CLKD_N. A source electrode of the first carry signal output transistor M16 is coupled with the carry signal output terminal CR(N).

A gate electrode of the second carry signal output transistor M17 is coupled with the pull-down node QB(N). A drain electrode of the second carry signal output transistor M17 is coupled with the carry signal output terminal CR(N). A source electrode of the second carry signal output transistor M17 receives the first low voltage VGL1.

In the specific embodiment of the gate driving unit shown in FIG. 9A, the input terminal Input may be coupled with a (N−2)-th stage carry signal output terminal CR(N−2); and the reset terminal Reset may be coupled with a (N+4)-th stage carry signal output terminal CR(N+4), but not limited to this.

In the specific embodiment of the gate driving unit shown in FIG. 9A, all of the transistors are n-type thin film transistors, but not limited thereto.

Figure 9B:
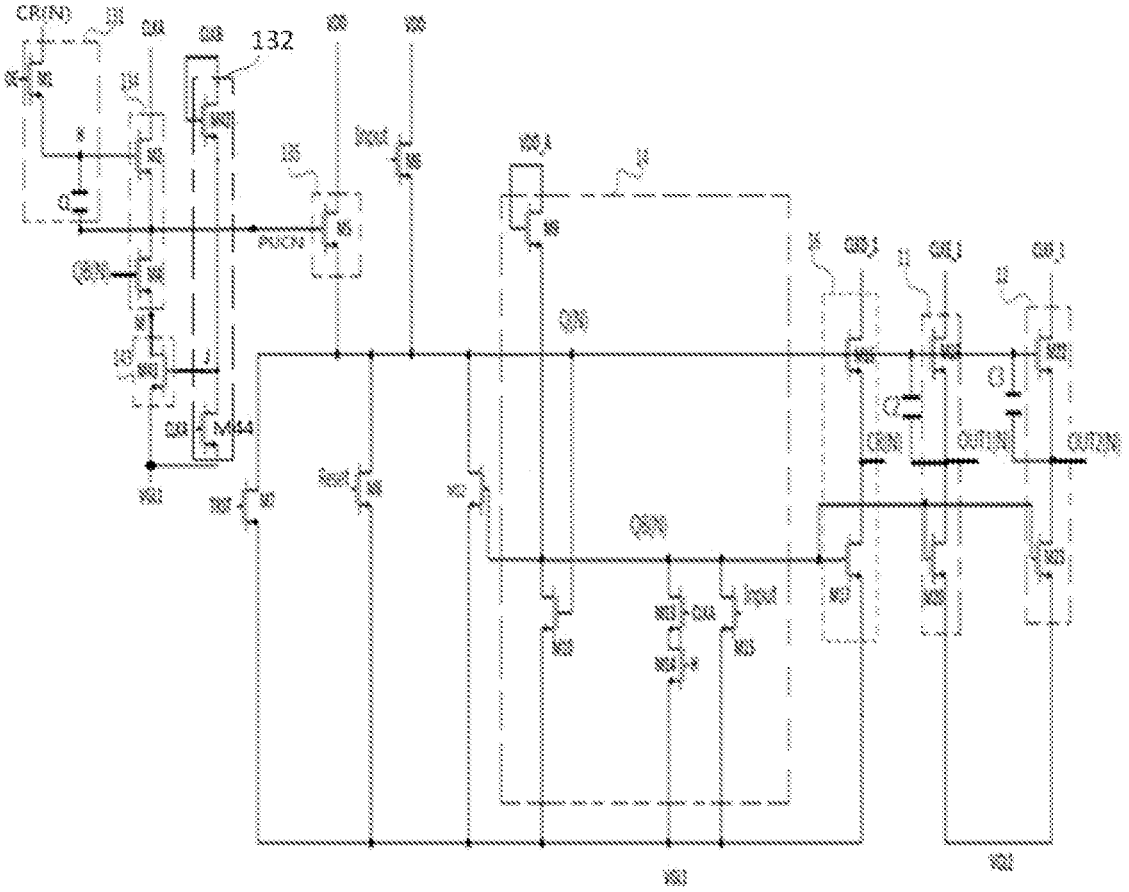
FIG. 9B is a circuit diagram of a gate driving unit according to another embodiment of the present disclosure.

As shown in FIG. 9B, in another specific embodiment of the gate driving unit of the present disclosure, on the basis of the gate driving unit shown in FIG. 9A according to an embodiment of the present disclosure, the second node control sub-circuit 132 further includes a second node control transistor M44.

A gate electrode of the second node control transistor M44 is coupled with the first clock signal terminal (the electrode of the second node control transistor M44 receives the first clock signal CLKA). A drain electrode of the second node control transistor M44 is coupled with the second node J. A source electrode of the second node control transistor M44 receives the first low voltage VGL1.

In another embodiment of the gate driving unit shown in FIG. 9B, M44 is an n-type thin film transistor, but is not limited thereto.

When the gate driving unit according to another embodiment of the present disclosure is in operation, when CLKA is high level, M44 is turned on to control the second node J to receive VGL1. When CLKA is low level, M44 is turned off.

Figure 10:
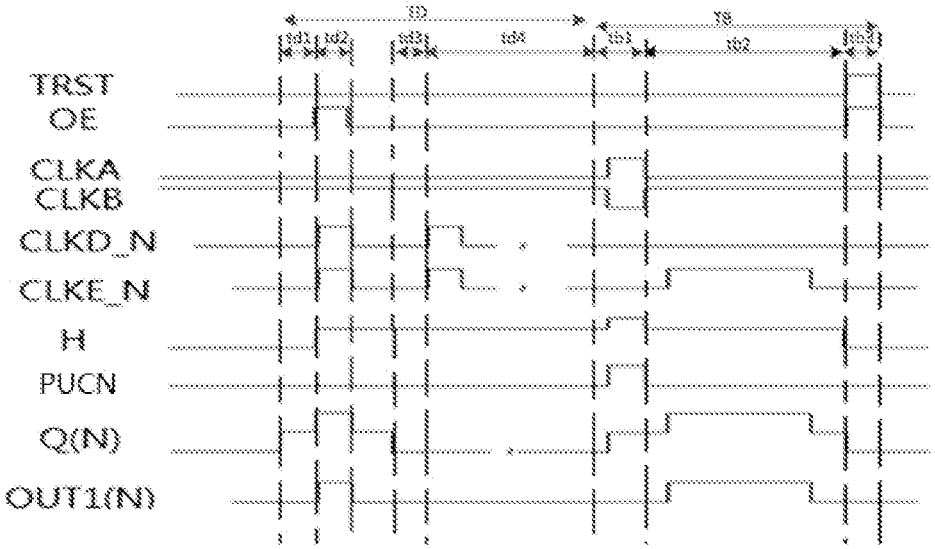
FIG. 10 is an operation timing diagram of a specific embodiment of the gate driving unit shown in FIG. 9A of the present disclosure.

As shown in FIG. 10, when the gate driving unit shown in FIG. 9A according to an embodiment of the present disclosure is in operation, a display period TD includes an input phase d1, an output phase d2, a reset phase td3, and an output cut-off hold phase td4. A blank time period TB includes a clock input phase tb1, an external compensation control signal output phase tb2 and a blank period reset phase tb3.

In the input phase td1 included in the display period TD, the input terminal Input inputs a high voltage, the reset terminal Reset inputs a low voltage, CLKB is a high voltage, CLKA is a low voltage; CLKD_N, CLKE_N and CLKF_N are each a low voltage; M6 is turned on, the pull-up node Q(N) receives VDD; M10 is turned on to pull down the potential at the pull-down node QB(N); M16, M19 and M22 are all turned on, and CR(N), OUT1(N) and OUT2(N) each output a low level; M15 is turned on to control the pull-down node QB(N) to receive VGL1.

In the output phase td2 included in the display period TD, both the input terminal Input and the reset terminal Reset input low voltage, CLKB is a high voltage, CLKA is a low voltage; CLKD_N, CLKE_N and CLKF_N are each a high voltage; the potential at the pull-up node Q(N) is raised by bootstrap of C2 and C3; M16, M19 and M22 are all turned on, CR(N), OUT1(N) and OUT2(N) each output high level. At this time, the enabling terminal OE inputs high level, M1 is turned on, so that the potential at the first node H is high voltage, M2 is turned on and PUCN receives CLKA so that the potential at PUCN is a low voltage; and M42 is turned on so that the potential at the gate electrode of M43 is high level, M43 is turned on. At this time, the potential at the pull-down node QB(N) is low voltage, and M4 is turned off.

In the hold phase between the output phase td2 and the reset phase td3, the potential at the pull-up node Q(N) is maintained to be a high voltage; CLKD_N, CLKE_N, and CLKF_N are each low voltages; M16, M19 and M22 are all turned on, CR(N), OUT1(N) and OUT2(N) each output low level.

In the reset phase td3 included in the display period TD, CLKB is a high voltage, CLKA is a low voltage, the input terminal Input inputs a low voltage, the reset terminal Reset inputs a high voltage; M8 is turned on to pull down the potential at the pull-up node Q(N), M10 is turned off, the potential at the pull-down node QB(N) is a high voltage; M4 is turned on, M42 is turned on, M43 is turned on, so that PUCN receives VGL1, M2 is turned on so that the potential at PUCN is low level, M5 is turned off; M17, M20 and M23 are all turned on to control each of CR(N), OUT1(N) and OUT2(N) to output low level.

In the output cut-off hold phase td4 included in the display period TD, CLKB is a high voltage, CLKA is a low voltage, the input terminal Input inputs a low voltage, the reset terminal Reset inputs a low voltage, the potential at the pull-down node QB(N) is a high voltage, the potential at the pull-up node Q(N) is a low voltage, M10 is turned off, M4 is turned on, M42 is turned on, M43 is turned on, so that PUCN receives VGL1, M2 is turned on so that the potential at PUCN is low level, M5 is turned off; M17, M20 and M23 are all turned on to control each of CR(N), OUT1(N) and OUT2(N) to output low level.

In the clock input phase tb1 included in the blank time period TB, CLKA is a high voltage, CLKB is a low voltage, the enabling terminal OE inputs a high voltage, M1 is turned on to control the potential at the first node H to be a high voltage, C1 maintains the potential at the first node H, M2 is turned on, the potential at PUCN is a high voltage, M5 is turned on, the potential at the pull-up node Q(N) is a high voltage, the potential at the pull-down node QB(N) is a low voltage, M42 and M4 are all turned off. At this time, CLKD_N, CLKE_N and CLKF_N are each a low voltage, M16, M19 and M22 are all turned on, and each of CR(N), OUT1(N) and OUT2(N) outputs low level.

In the external compensation control signal output phase tb2 included in the blank time period TB, the enabling terminal OE inputs low level, M1 is turned off, C1 controls the potential at the first node H to be high level, M2 is turned on, CLKB is a high voltage, CLKA is a low voltage, the potential at PUCN is a low voltage, C2 and C3 maintain the potential at the pull-up node Q(N), CLKD_N and CLKF_N are each a low voltage, CLKE_N is a high voltage, M16, M19 and M22 are all turned on, OUT1(N) outputs a high voltage, and each of CR(N) and OUT(2) outputs a low voltage.

In the blank period reset phase td3 included in the blank time period, the enabling terminal OE inputs a high voltage, TRST inputs a high voltage, M1 is turned on, CR(N) inputs a low voltage to pull down the potential at the first node H, M7 is turned on to pull down the potential at the pull-up node Q(N), thereby controlling each of M16, M19 and M22 to turn off.

When the gate driving unit according to an embodiment of the present disclosure is in operation, in the output phase of the display period, when CR(N) outputs a high voltage, the enabling terminal OE also inputs a high voltage to charge the first node H. In the output phase, the reset phase and the output cut-off hold phase of the display period, the enabling terminal OE inputs a low potential, and the high potential at the first node H is held until the blank time period. In the display period, M5 is always turned off, to isolate the influence of a sense pre-charge voltage point (which is the first node H) on the displaying. The potential at the pull-up node Q(N) presents a tower-like waveform, rising and falling edges of the carry signal output by CR are formed by the same large-sized driving transistor (M16), and rising and falling edges of the gate driving signal output by OUT2(N) are formed by the same large-sized driving transistor (M22), thereby greatly reduce layout area.

In FIG. 9A and FIG. 9B, all of the capacitors may be parasitic capacitances of thin film transistors (TFTs) or external capacitors.

A gate driving method according to an embodiment of the present disclosure is applied to the above gate driving unit. There is a blank time period between two display periods. The gate driving method includes:

in the display period, controlling, by the pull-up control circuit under control of an enabling signal input by the enabling terminal and a current-stage driving signal, a potential at the first node to be an effective voltage, and maintaining the potential at the first node to be the effective voltage; controlling, by the pull-up control circuit under control of the potential at the first node, a first clock signal input by the first clock signal terminal, a second clock signal input by the second clock signal terminal and a potential at the pull-down node, a potential at the pull-up control node to be an ineffective voltage;

in a preset time period of the blank time period after the display period, maintaining, by the pull-up control circuit, the potential at the first node to be the effective voltage; controlling, by the pull-up control circuit under control of the potential at the first node and the first clock signal input by the first clock signal terminal, the potential at the pull-up control node; controlling, by the pull-up control circuit under control of the potential at the pull-up control node, a potential at the pull-up node to be an effective voltage; and, controlling, by the external compensation control signal output circuit under control of the potential at the pull-up node, the external compensation control signal output terminal to be coupled with the external compensation clock signal terminal.

The gate driving unit in one embodiment of the present disclosure can simultaneously output the gate driving signal and the external compensation control signal. Meanwhile, random compensation can be performed by employing the gate driving unit in the embodiment of the present disclosure, and then sweep lines and brightness deviation of a panel can be eliminated by employing the random compensation.

Specifically, the pull-up control circuit may include a first node control sub-circuit, a second node control sub-circuit, a third node control sub-circuit, a pull-up control node control sub-circuit and a pull-up control sub-circuit. In the display period, the first clock signal terminal inputs an ineffective voltage, the second clock signal terminal inputs an effective voltage; the preset time period includes a clock input phase and an external compensation output phase which are sequentially set. The gate driving method includes:

in an output phase included in the display period, inputting, by the enabling terminal, an effective voltage, the current-stage driving signal being an effective voltage; controlling, by the first node control sub-circuit, the first node to receive the current-stage driving signal; controlling, by the pull-up control node control sub-circuit, the pull-up control node to be coupled with the first clock signal terminal; controlling, by the pull-up control sub-circuit, the pull-up node to be dis-coupled with the third voltage terminal;

in a reset phase and an output cut-off hold phase included in the display period, inputting, by the enabling terminal, an ineffective voltage, the potential at the pull-down node being an effective voltage; maintaining, by the first node control sub-circuit, the potential at the first node; controlling, by the second node control sub-circuit, the potential at the second node to be an effective voltage; controlling, by the third node control sub-circuit, the third node to be coupled with the second voltage terminal; controlling, by the pull-up control node control sub-circuit, the pull-up control node to be coupled with the first clock signal terminal, and controlling the pull-up control node to be coupled with the third node; controlling, by the pull-up control sub-circuit, the pull-up node to be dis-coupled with the third voltage terminal;

in the clock input phase and the external compensation output phase in the blank time period after the display period, maintaining, by the first node control sub-circuit, the potential at the first node;

where in the clock input phase, the first clock signal terminal inputs an effective voltage, the second clock signal input terminal inputs an ineffective voltage; the pull-up control node control sub-circuit controls the pull-up control node to be coupled with the first clock signal terminal; the pull-up control sub-circuit controls the pull-up node to be coupled with the third voltage terminal, thereby controlling the potential at the pull-up node to be an effective voltage;

where in the external compensation output phase, the first clock signal terminal inputs an effective voltage, the second clock signal terminal inputs an ineffective voltage; the first node control sub-circuit maintains the potential at the first node to be an effective voltage; the pull-up control node control sub-circuit controls the pull-up control node to be coupled with the first clock signal terminal; the pull-up control sub-circuit dis-couples the pull-up node from the third voltage terminal, thereby maintaining the potential at the pull-up node to be an effective voltage; the external compensation clock signal terminal inputs an effective voltage, and the external compensation control signal output circuit controls the external compensation control signal output terminal to be coupled with the external compensation clock signal terminal.

Specifically, the blank time period further includes a blank period reset phase after the preset time period. The gate driving method may further include:

in the blank period reset phase, inputting, by the enabling terminal, a high voltage, a current-stage driving signal being an ineffective voltage; controlling, by the first node control sub-circuit, the first node to receive the current-stage driving signal, thereby resetting the potential at the first node.

In a specific implementation, the gate driving unit further includes a pull-up node control circuit. The gate driving method further includes:

in the blank period reset phase, inputting, by the blank period reset terminal, an effective voltage to reset the potential at the pull-up node.

A gate driving module according to an embodiment of the present disclosure includes the above gate driving unit. The gate driving unit is an N-th stage gate driving unit, where N is a positive integer. The gate driving module further includes a (N+1)-th stage gate driving unit.

A pull-up node in the (N+1)-th stage gate driving unit is a (N+1)-th pull-up node. A pull-down node in the (N+1)-th gate driving unit is a (N+1)-th pull-down node. A pull-up control node in the (N+1)-th gate driving unit is a pull-up control node in the N-th stage gate driving unit.

The (N+1)-th gate driving unit includes a (N+1)-th stage pull-up control circuit, a (N+1)-th stage external compensation control signal output terminal, a (N+1)-th stage gate driving signal output terminal, a (N+1)-th stage external compensation control signal output circuit, a (N+1)-th stage gate driving signal output circuit, and a (N+1)-th stage pull-down node control circuit.

The (N+1)-th stage pull-up control circuit is coupled with the N-th pull-up control node, and is configured to, under control of a potential at the N-th pull-up control node, control the (N+1)-th pull-up node to be coupled with a third voltage terminal.

The (N+1)-th stage pull-down node control circuit is configured to control a potential at the (N+1)-th pull-down node.

The (N+1)-th stage external compensation control signal output circuit is configured to, under control of the potential at the (N+1)-th pull-up node, control the (N+1)-th stage external compensation control signal output terminal to be coupled with the second external compensation clock signal terminal; under control of the potential at the (N+1)-th pull-down node, control the external compensation control signal output terminal to be coupled with the first voltage terminal.

The (N+1)-th stage gate driving signal output circuit is configured to, under control of the potential at the (N+1)-th pull-up node and the potential at the (N+1)-th pull-down node, control the (N+1)-th stage gate driving signal output terminal to output a gate driving signal.

In the gate driving module according to one embodiment of the present disclosure, the pull-up control circuit (i.e., the (N+1)-th stage pull-up control circuit) in the (N+1)-th stage gate driving unit is coupled with the N-th pull-up node. Under control of the potential at the N-th pull-up control node, the (N+1)-th stage pull-up control circuit controls the potential at the (N+1)-th pull-up node. In other words, the (N+1)-th stage pull-up control circuit does not include the first node control sub-circuit, the second node control sub-circuit, the third node control sub-circuit and the pull-up control node control sub-circuit, the (N+1)-th pull-up control circuit only includes a pull-up control sub-circuit, and the (N+1)-th stage pull-up control circuit only includes the pull-up control sub-circuit. Further, the (N+1)-th stage gate driving unit does not employ the carry signal output circuit and the corresponding stage carry signal output terminal, thereby simplifying the structure of the gate driving module while still realizing that the (N+1)-th stage gate driving unit can normally output a (N+1)-th gate driving signal and a (N+1)-th external compensation control signal.

In the embodiment of the present disclosure, the first voltage terminal may be a low voltage terminal, and the third voltage terminal may be a high voltage terminal, but is not limited thereto.

Figure 11:
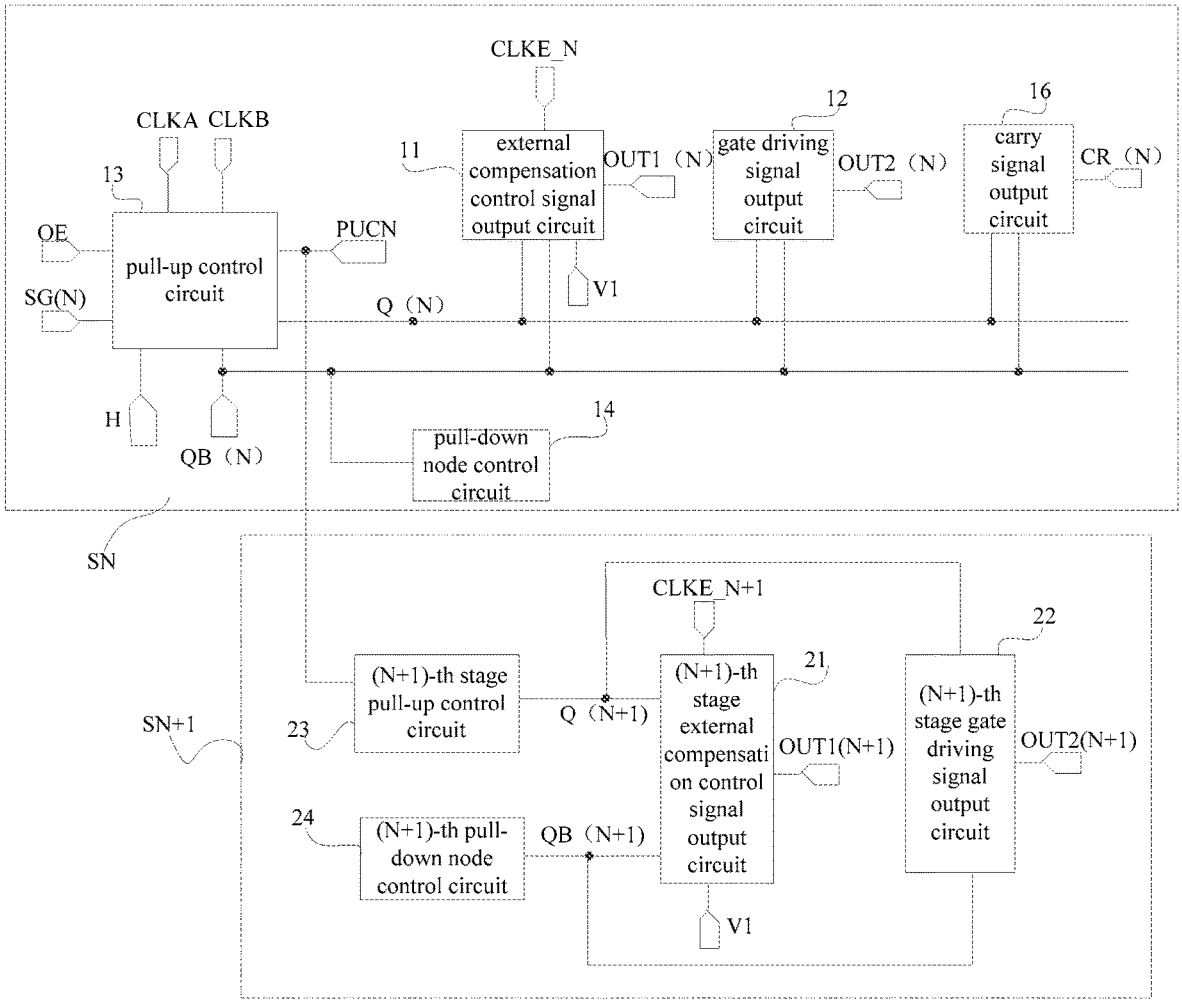
FIG. 11 is a block diagram of a gate driving module according to an embodiment of the present disclosure.

As shown in FIG. 11, a gate driving module according to one embodiment of the present disclosure includes the gate driving unit shown in FIG. 8. The gate driving unit is an N-th stage gate driving unit SN, where N is a positive integer. The gate driving module further includes a (N+1)-th stage gate driving unit (SN+1).

A pull-up node in the (N+1)-th stage gate driving unit (SN+1) is a (N+1)-th pull-up node Q(N+1). A pull-down node in the (N+1)-th stage gate driving unit (SN+1) is a (N+1)-th pull-down node QB(N+1). A pull-up control node in the (N+1)-th stage gate driving unit is a pull-up control node PUCN in the N-th stage gate driving unit. The pull-up control node PUCN is an N-th pull-up control node.

The (N+1)-th stage gate driving unit (SN+1) includes a (N+1)-th pull-up control circuit 23, a (N+1)-th stage external compensation control signal output terminal OUT1(N+1), a (N+1)-th stage gate driving signal output terminal OUT2 (N+1), a (N+1)-th stage external compensation control signal output circuit 21, a (N+1)-th stage gate driving signal output circuit 22 and a (N+1)-th pull-down node control circuit 24.

The (N+1)-th stage pull-up control circuit 23 is coupled with the N-th pull-up control node PUCN, and is configured to, under control of a potential at the N-th pull-up control node PUCN, control a (N+1)-th pull-up node Q(N+1) to be coupled with a high voltage terminal. The high voltage terminal is configured to input a high voltage VDD.

The (N+1)-th pull-down node control circuit 24 is configured to control a potential at the (N+1)-th pull-down node QB(N+1).

The (N+1)-th external compensation control signal output circuit 21 is configured to, under control of the potential at the (N+1)-th pull-up node, control the (N+1)-th external compensation control signal output terminal OUT1(N+1) to be coupled with a second external compensation clock signal terminal CLKE_N+1; under control of the potential at the (N+1)-th pull-down node QB(N+1), control the external compensation control signal output terminal OUT1(N+1) to be coupled with the first voltage terminal. The first voltage terminal is configured to input a first voltage V1.

The (N+1)-th gate driving signal output circuit 22 is configured to, under control of the potential at the (N+1)-th pull-up node Q(N+1) and the potential at the (N+1)-th pull-down node QB(N+1), control the (N+1)-th stage gate driving signal output terminal OUT2(N+1) to output a gate driving signal.

In the gate driving module according to one embodiment of the present disclosure, the pull-up control circuit (i.e., the (N+1)-th pull-up control circuit) in the (N+1)-th gate driving unit (SN+1) is coupled with the N-th pull-up control node. Under control of the potential at the N-th pull-up control node, the (N+1)-th pull-up control circuit controls the potential at the (N+1)-th pull-up node Q(N+1). In other words, the (N+1)-th pull-up control circuit does not include the first node control sub-circuit 131, the second node control sub-circuit 132, the third node control sub-circuit 133, the pull-up control node control sub-circuit 134, and the (N+1)-th pull-up control circuit only includes the pull-up control sub-circuit 135. Further, the (N+1)-th stage gate driving unit (SN+1) does not employ the carry signal output circuit and the corresponding stage carry signal output terminal, thereby simplifying the structure of the gate driving module while still realizing that the (N+1)-th stage gate driving unit (SN+1) can normally output a (N+1)-th gate driving signal and a (N+1)-th external compensation control signal.

When the gate driving module shown in FIG. 11 according to an embodiment of the present disclosure is in operation, if a (N+1)-th row pixel circuit needs to be externally compensated, then, in an N-th output phase of the display period, an enabling terminal coupled with the N-th stage gate driving unit, is controlled to input an effective voltage, so that the potential at the PUCN can be controlled to be an effective voltage in the clock input phase of the blank time period, thereby controlling the potential at Q(N+1) to be an effective voltage, and maintaining the potential at Q(N+1) to be the effective voltage in the external compensation output phase of the blank time period. At this time, CLKE_2 inputs an effective voltage, and the (N+1)-th external control signal output terminal OUT1 (N+1) in the (N+1)-th stage gate driving unit outputs an effective voltage.

Specifically, the (N+1)-th stage gate driving unit further includes a (N+1)-th pull-up node control circuit.

The (N+1)-th pull-up node control circuit is coupled with the input terminal, the reset terminal, the (N+1)-th pull-up node, the (N+1)-th pull-down node, the blank period reset terminal, the third voltage terminal and the fourth voltage terminal, respectively. The (N+1)-th pull-up node control circuit is configured to, under control of an input signal input by the input terminal, control the (N+1)-th pull-up node to be coupled with the third voltage terminal; under control of a reset signal input by the reset terminal, control the (N+1)-th pull-up node to be coupled with the fourth voltage terminal; under control of a blank period reset signal input by the blank period reset terminal, control the (N+1)-th pull-up node to be coupled with the fourth voltage terminal; under control of the potential at the (N+1)-th pull-down node, control the (N+1)-th pull-up node to be coupled with the fourth voltage terminal, and maintain the potential at the (N+1)-th pull-up node.

In a specific implementation, the input terminal coupled with the (N+1)-th pull-up node control circuit, is the input terminal coupled with the N-th pull-up node control circuit; the reset terminal coupled with the (N+1)-th pull-up node control circuit, is the reset terminal coupled with the N-th pull-up node control circuit. In other words, the (N+1)-th pull-up node control circuit and the N-th pull-up node control circuit share the same input terminal, and the (N+1)-th pull-up node control circuit and the N-th pull-up node control circuit share the same reset terminal.

In a specific implementation, the pull-up control circuit in the N-th stage gate driving unit is an N-th pull-up control circuit. The N-th pull-up control circuit includes a first node control sub-circuit, a second node control sub-circuit, a third node control sub-circuit, a pull-up control node control sub-circuit and a pull-up control sub-circuit.

The (N+1)-th pull-down node control circuit is coupled with the second control voltage terminal, the (N+1)-th pull-up node, the (N+1)-th pull-down node, the first node in the N-th stage gate driving unit, the first clock signal terminal, the reset terminal and a fifth voltage terminal, respectively. The (N+1)-th pull-down node control circuit is configured to, under control of the second control voltage input by the second control voltage terminal and the potential at the (N+1)-th pull-up node, control a potential at the (N+1)-th pull-down node; under control of the potential at the first node and a first clock signal input by the first clock signal terminal, control the (N+1)-th pull-down node to be coupled with the fifth voltage terminal; under control of the input signal input by the input terminal, control the pull-down node to be coupled with the fifth voltage terminal.

In a specific implementation, the first node coupled with the (N+1)-th pull-down node control circuit, is the first node coupled with the N-th pull-down node control circuit. That is, the N-th pull-up node control circuit and the (N+1)-th pull-up node control circuit shares the same first node.

Specifically, the external compensation control signal output circuit in the N-th stage gate driving unit is an N-th external compensation control signal output circuit. The gate driving signal output circuit in the N-th stage gate driving unit is the N-th gate driving signal output circuit. The external compensation control signal output terminal in the N-th stage gate driving unit is an N-th stage external compensation control signal output terminal. The gate driving signal output terminal in the N-th stage gate driving unit is the N-th stage gate driving signal output terminal. The pull-up node in the N-th stage gate driving unit is an N-th pull-up node. The pull-down node in the N-th stage gate driving unit is an N-th pull-down node.

The N-th external compensation control signal output circuit is further coupled with the (N+1)-th pull-down node, and is configured to, under control of the potential at the (N+1)-th pull-down node, reset the N-th external compensation control signal output terminal.

The N-th gate driving signal output circuit is further coupled with the (N+1)-th pull-down node, and is configured to, under control of the potential at the (N+1)-th pull-down node, reset the N-th gate driving signal output terminal.

The (N+1)-th external compensation control signal output circuit is further coupled with the N-th pull-down node, and is configured to, under control of the potential at the N-th pull-down node, reset the (N+1)-th stage external compensation control signal output terminal.

The (N+1)-th gate driving signal output circuit is further coupled with the N-th pull-down node, and is configured to, under control of the potential at the N-th pull-down node, reset the (N+1)-th stage gate driving signal output terminal.

In a specific implementation, the gate driving unit in one embodiment of the present disclosure may be a first-stage gate driving unit in the gate driving module according to the embodiment of the present disclosure, and may be an N-th stage gate driving unit in a gate driving circuit according to the embodiment of the present disclosure. A second-stage gate driving unit in the gate driving module according to the embodiment of the present disclosure may be a (N+1)-th stage gate driving unit in the gate driving circuit according to the embodiment of the present disclosure. The (N+1)-th stage gate driving unit does not include the carry signal output terminal and the carry signal output circuit, and the pull-up node control circuit in the (N+1)-th stage gate driving unit only includes a pull-up node control sub-circuit. The (N+1)-th pull-up node control sub-circuit is coupled with the pull-up control node N in the N-th stage gate driving unit, and is configured to, under control of the potential at the N-th pull-up control node, control the potential at the pull-up node in the (N+1)-th gate driving unit. The input terminal of the (N+1)-th gate driving unit is coupled with the input terminal of the N-th stage gate driving unit. The reset terminal in the (N+1)-th stage gate driving unit is coupled with the reset terminal in the N-th gate driving unit terminal.

The pull-down node in the N-th stage gate driving unit may be a first pull-down node. The first pull-down node is controlled by the pull-up node Q(N) in the N-th stage gate driving unit and the first control voltage VDDo. The pull-down node in the (N+1)-th gate driving unit may be a second pull-down node. The second pull-down node is controlled by the pull-up node in the (N+1)-th gate driving unit and the second control voltage. In the gate driving module according to one embodiment of the present disclosure, the carry signal output circuit in the (N+1)-th gate driving unit may be further coupled with the second pull-down node. Under control of the potential at the second pull-down node, the carry signal output circuit in the (N+1)-th gate driving unit resets the carry signal. The external compensation control signal output circuit in the (N+1)-th stage gate driving unit may further be coupled with the second pull-down node. Under control of the potential at the second pull-down node, the external compensation control signal output circuit in the (N+1)-th stage gate driving unit resets the external compensation control signal. The gate driving signal output circuit in the gate driving unit may further be coupled with the second pull-down node. Under control of the potential at the second pull-down node, the gate driving signal output circuit in the gate driving unit resets the gate driving signal. The external compensation control signal output circuit in the (N+1)-th stage gate driving unit may be simultaneously coupled with the first pull-down node and the second pull-down node. Under control of the potential at the first pull-down node and the potential at the second pull-down node, the external compensation control signal output circuit in the (N+1)-th stage gate driving unit resets the external compensation control signal. The gate driving signal output circuit in the gate driving unit may further be coupled with the second pull-down node. Under control of the potential at the first pull-down node and the second pull-down node, the gate driving signal output circuit in the gate driving unit resets the gate driving signal.

In a specific implementation, the display time may include a plurality of display time periods. The display time period includes a first voltage supply phase and a second voltage supply phase, which are sequentially set. In the first voltage supply phase, the first control voltage is a high voltage, and the second control voltage is a low voltage. In the second voltage supply phase, the first control voltage is a low voltage, and the second control voltage is a high voltage. With the above voltage settings, the potential at the first pull-down node and the potential at the second pull-down node are alternately set to an effective voltage, thereby improving threshold voltage drift of the transistor with its gate electrode coupled with the first pull-down node, improving threshold voltage drift of the transistor with its gate electrode coupled with the second pull-down node, improving threshold voltage drift of the transistor with its gate electrode coupled with the first control voltage terminal, and improving threshold voltage drift of the transistor with its gate electrode coupled with the second control voltage terminal.

Figure 12:
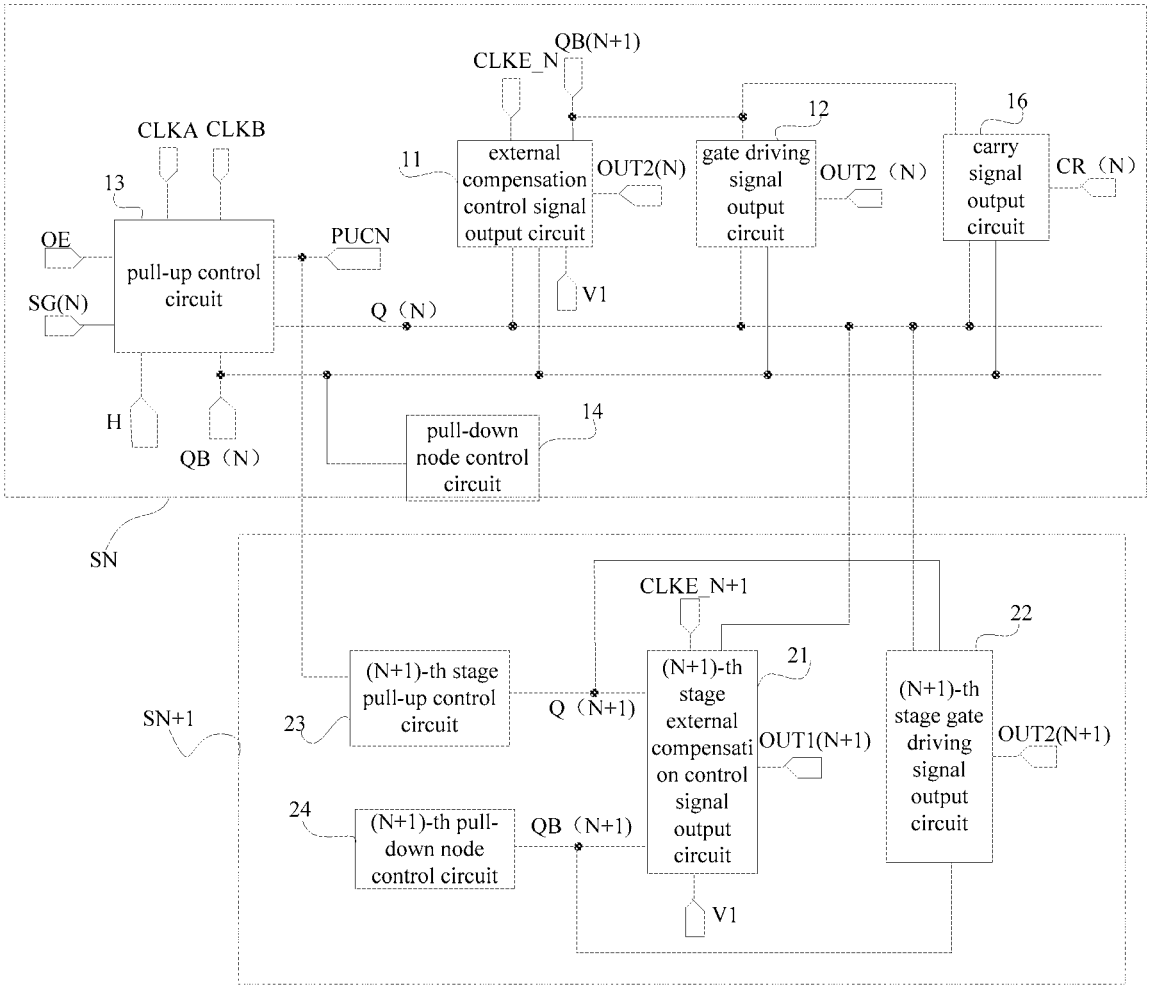
FIG. 12 is a block diagram of a gate driving module according to another embodiment of the present disclosure.

As shown in FIG. 12, on the basis of the gate driving module shown in FIG. 11, the external compensation control signal output circuit 11 in the N-th stage gate driving unit SN is an N-th external compensation control signal output circuit; the gate driving signal output circuit 12 in the N-th stage gate driving unit SN is an N-th gate driving signal output circuit; the carry signal output circuit 16 in the N-th stage gate driving unit SN is an N-th carry signal output circuit; an external compensation control signal output terminal OUT1(N) in the N-th stage gate driving unit SN is an N-th external compensation control signal output terminal; the gate driving signal output terminal OUT2(N) in the N-th stage gate driving unit SN is an N-th stage gate driving signal output terminal; the pull-up node Q(N) in the N-th stage gate driving unit SN is an N-th pull-up node; and the pull-down node QB(N) in the N-th gate driving unit SN is an N-th pull-down node;

the N-th external compensation control signal output circuit 11 is further coupled with the (N+1)-th pull-down node QB(N+1), and is configured to, under control of the potential at the (N+1)-th pull-down node QB(N+1), reset the N-th stage external compensation control signal output terminal OUT1(N);

the N-th gate driving signal output circuit 12 is further coupled with the (N+1)-th pull-down node QB(N+1), and is configured to, under control of the potential at the (N+1)-th pull-down node QB(N+1), reset the N-th gate driving signal output terminal OUT2(N);

the N-th carry signal output circuit 16 is further coupled with the (N+1)-th pull-down node QB(N+1), and is configured to, under control of the potential at the (N+1)-th pull-down node QB(N+1), reset the N-th stage carry signal output terminal CR(N);

the (N+1)-th external compensation control signal output circuit 21 is further coupled with the N-th pull-down node QB(N), and is configured to, under control of the potential at the N-th pull-down node Q(N), reset the (N+1)-th stage external compensation control signal output terminal OUT1(N);

the (N+1)-th gate driving signal output circuit 22 is further coupled with the N-th pull-down node QB(N), and is configured to, under control of the potential at the N-th pull-down node QB(N), reset the (N+1)-th stage gate driving signal output terminal OUT2(N).

Optionally, SN is also coupled with QB(N+1), and SN+1 is also coupled with QB(N). That is, under control of the potential at QB(N) and the potential at QB(N+1), the N-th external compensation control signal output circuit 11 resets the OUT1(N). Under control of the potential at QB(N) and the potential at QB(N+1), the N-th gate driving signal output circuit 12 resets OUT2(N). Under control of the potential at QB(N) and the potential at QB(N+1), the (N+1)-th external compensation control signal output circuit 21 resets OUT1(N+1). Under control of the potential at QB(N) and the potential at QB(N+1), the (N+1)-th gate driving signal output circuit 22 resets OUT2(N+1). The potential at QB(N) is controlled to be opposite to the potential at QB(N+1), that is, when the potential at QB(N) is an effective voltage, the potential at QB(N+1) is an ineffective voltage; when the potential at QB(N+1) is an effective voltage, the potential at QB(N) is an ineffective voltage, thereby improving threshold voltage drift of the transistor with its gate electrode coupled with QB(N) and node, improving threshold voltage drift of the transistor with its gate electrode coupled with QB(N+1).

Figure 13:
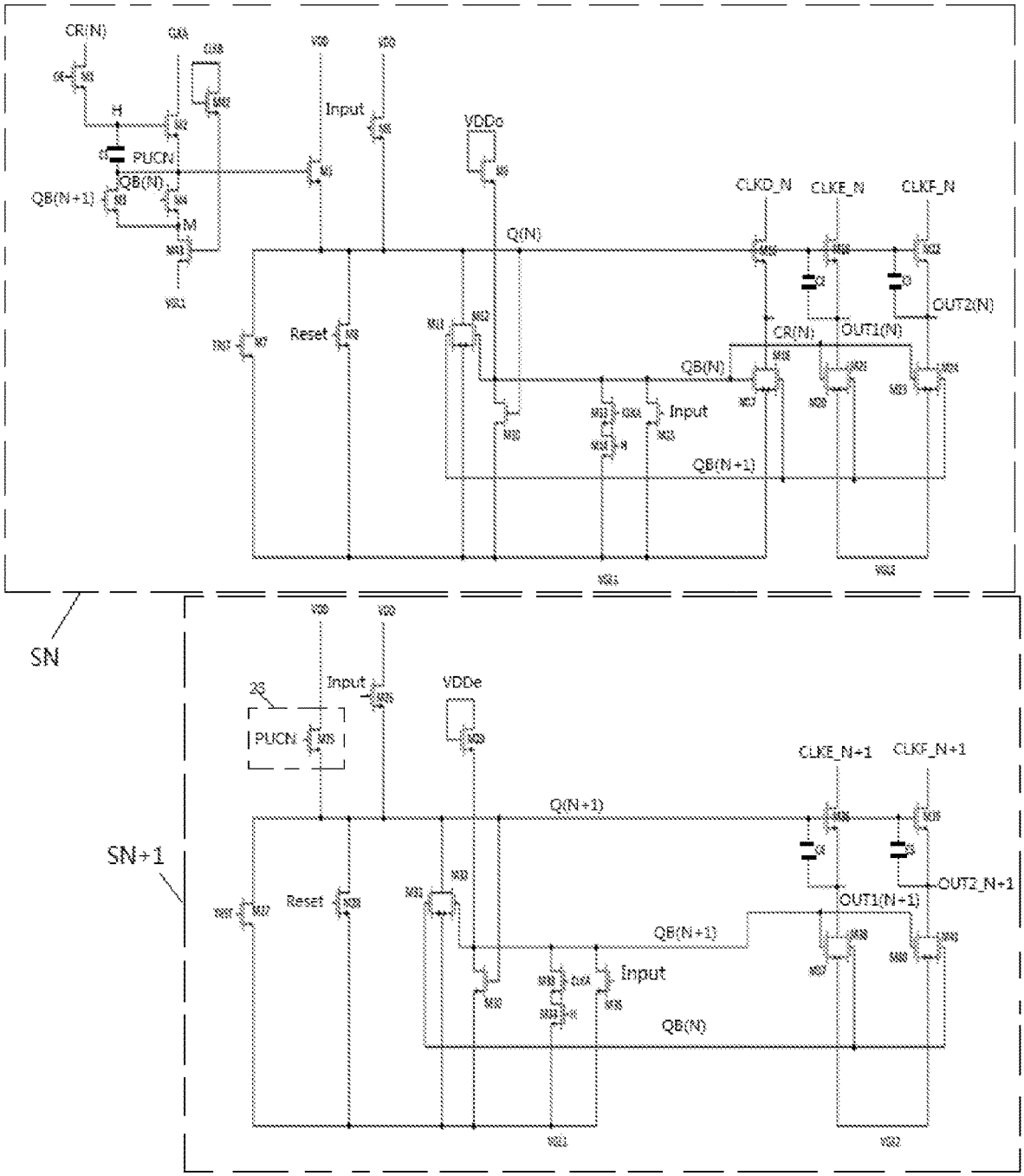
FIG. 13 is a circuit diagram of a gate driving module according to another embodiment of the present disclosure.

As shown in FIG. 13, a gate driving module according to one embodiment of the present disclosure includes an N-th stage gate driving unit SN and a (N+1)-th stage gate driving unit (SN+1).

The N-th stage gate driving unit SN includes the gate driving unit as shown in FIG. 9A and a first reset circuit. The pull-down node QB(N) in FIG. 9A is an N-th pull-down node.

The first reset circuit includes a first reset transistor M18, a second reset transistor M21, a third reset transistor M24 and a fourth reset transistor M11.

The (N+1)-th stage gate driving unit (SN+1) includes a (N+1)-th external compensation control signal output terminal OUT1(N+1), a (N+1)-th gate driving signal output terminal OUT2(N+1), a (N+1)-th external compensation control signal output circuit, a (N+1)-th gate driving signal output circuit, a (N+1)-th pull-up control circuit 23, a (N+1)-th pull-down node control circuit, and a (N+1)-th pull-up node control circuit.

The (N+1)-th pull-up control circuit 23 includes a (N+1)-th pull-up control transistor M25.

A gate electrode of M25 is coupled with the pull-up control node PUCN. A drain electrode of M25 receives a high voltage VDD. A source electrode of M25 is coupled with the (N+1)-th pull-down node Q(N+1).

The (N+1)-th pull-up node control circuit includes a fifth pull-up node control transistor M26, a sixth pull-up node control transistor M28, a seven-th pull-up node control transistor M27, an eighth pull-up node control transistor M32, and a ninth pull-up node control transistor M31, a third storage capacitor C4 and a fourth storage capacitor C5.

A gate electrode of M26 is coupled with an input terminal. A drain electrode of M26 receives the high voltage VDD. A source electrode of M26 is coupled with the (N+1)-th pull-up node Q(N+1).

A gate electrode of M28 is coupled with the reset terminal Reset. A drain electrode of M28 is coupled with Q(N+1). A source electrode of M28 receives a first low voltage VGL1.

A gate electrode of M27 is coupled with the blank period reset terminal TRST. A drain electrode of M27 is coupled with Q(N+1). A source electrode of M27 receives the first low voltage VGL1.

A gate electrode of M32 is coupled with the (N+1)-th pull-down node QB(N+1). A drain electrode of M32 is coupled with Q(N+1). A source electrode of M12 receives the first low voltage VGL1.

A gate electrode of M31 is coupled with QB(N). A drain electrode of M32 is coupled with Q(N+1). A source electrode of M12 receives the first low voltage VGL1.

A first terminal of C4 is coupled with Q(N+1). A second terminal of C4 is coupled with OUT1(N+1).

A first terminal of C5 is coupled with Q(N+1). A second terminal of C5 is coupled with OUT2(N+1).

The (N+1)-th pull-down node control circuit includes a sixth pull-down control transistor M29, a seven-th pull-down control transistor M30, an eighth pull-down control transistor M33, a ninth pull-down control transistor M34, and a tenth pull-down control transistor M35.

A gate electrode of M29 and a drain electrode of M29 are both coupled with the second control voltage terminal. A source electrode of M29 is coupled with the (N+1)-th pull-down node QB(N+1). The second control voltage terminal is configured to input a second control Voltage VDDe.

A gate electrode of M30 is coupled with Q(N+1). A drain electrode of M30 is coupled with QB(N+1). A source electrode of M30 receives the first low voltage VGL1.

A gate electrode of M33 receives the first clock signal CLKA. A drain electrode of M33 is coupled with QB(N+1).

A gate electrode of M34 is coupled with the first node H. A drain electrode of M34 is coupled with a source electrode of M33. A source electrode of M34 receives the first low voltage VGL1.

A gate electrode of M35 is coupled with the input terminal Input. A drain electrode of M35 is coupled with QB(N+1). A source electrode of M35 receives the first low voltage VGL1.

The (N+1)-th external compensation control signal output circuit includes a third compensation output transistor M36, a fourth compensation output transistor M37 and a fifth compensation output transistor M38.

A gate electrode of M36 is coupled with Q(N+1). A drain electrode of M36 receives a (N+1)-th external compensation clock signal CLKE_N+1. A source electrode of M36 is coupled with OUT1(N+1).

A gate electrode of M37 is coupled with the pull-down node QB(N+1). A drain electrode of M37 is coupled with OUT1(N+1). A source electrode of M37 receives the second low voltage VGL2.

A gate electrode of M38 is coupled with the pull-down node QB(N). A drain electrode of M38 is coupled with OUT1(N+1). A source electrode of M38 receives the second low voltage VGL2.

The gate driving signal output circuit includes a third gate driving signal output transistor M39, a fourth gate driving signal output transistor M40 and a fifth gate driving signal output transistor M41.

A gate electrode of M39 is coupled with Q(N+1). A drain electrode of M39 receives a (N+1)-th gate driving output clock signal CLKF_N. A source electrode of M39 is coupled with OUT2(N+1).

A gate electrode of M40 is coupled with QB(N+1). A drain electrode of M40 is coupled with OUT2(N+1). A source electrode of M40 receives the second low voltage VGL2.

A gate electrode of M18 is coupled with QB(N+1). A drain electrode of M18 is coupled with CR(N). A source electrode of M18 receives VGL1.

A gate electrode of M21 is coupled with QB(N+1). A drain electrode of M21 is coupled with OUT1(N). A source electrode of M21 receives VGL2.

A gate electrode of M24 is coupled with QB(N+1). A drain electrode of M21 is coupled with OUT2(N). A source electrode of M21 receives VGL2.

A gate electrode of M11 is coupled with QB(N+1). A drain electrode of M11 is coupled with Q(N). A source electrode of M11 receives VGL1.

In the embodiment shown in FIG. 13, the input terminal Input is coupled with the carry signal output terminal CR(N−2) of the (N−2)-th stage gate driving unit. The reset terminal Reset is coupled with the carry signal output terminal CR(N+4) of the (N+4)-th stage gate driving unit.

In the embodiment shown in FIG. 13, all of the transistors are n-type thin film transistors, but are not limited thereto.

In the embodiment shown in FIG. 13, N is equal to 5, that is, SN is a fifth-stage gate driving unit, and (SN+1) is a sixth-stage gate driving unit.

Figure 14:
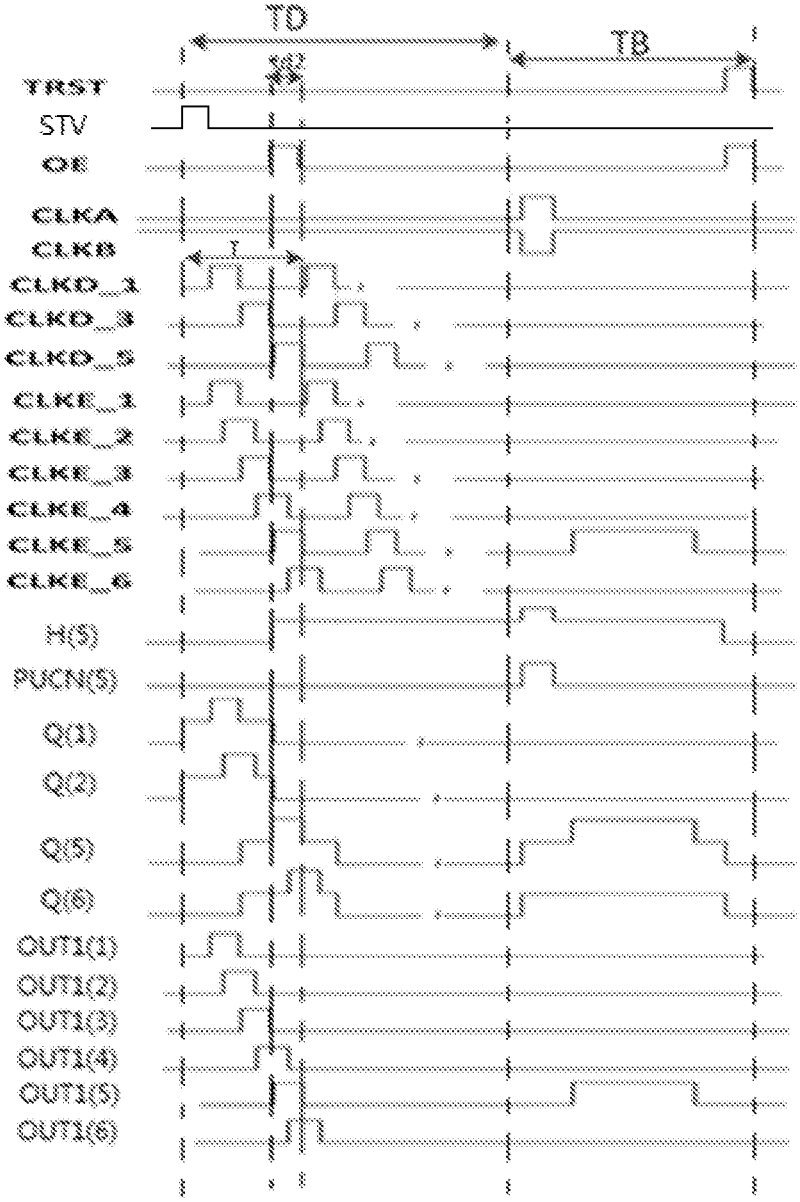
FIG. 14 is an operation timing diagram of a gate driving module according to another embodiment of the present disclosure.

FIG. 14 is an operation timing diagram of the gate driving module shown in FIG. 13 of the present disclosure.

In FIG. 14, the reference numeral TD represents a display period; the reference numeral td2 represents an output phase. In the output phase td2, the external compensation control signal output by the fifth-stage gate driving unit is a high voltage, that is, OUT1(5) outputs a high voltage. In FIG. 14, the reference numeral TB represents a blank time period.

In FIG. 14, the reference numeral CLKD_1 represents a first carry output clock signal. The reference numeral CLKD_3 represents a third carry output clock signal. The reference numeral CLKD_5 represents a fifth carry output clock signal. The reference numeral CLKE_1 represents a first external compensation clock signal. The reference numeral CLKE_2 represents a second external compensation clock signal. The reference numeral CLKE_3 represents a third external compensation clock signal. The reference numeral CLKE_4 represents a fourth external compensation clock signal. The reference numeral CLKE_5 represents a fifth external compensation clock signal. The reference numeral CLKE_6 represents a sixth external compensation clock signal. The reference numeral H(5) represents a first node in the fifth-stage gate driving unit. The reference numeral PUCN(5) represents a pull-up control node in the fifth-stage gate driving unit. The reference numeral Q(5) represents a pull-up node in the fifth-stage gate driving unit. The reference numeral Q(6) represents a pull-up node in the sixth-stage gate driving unit. The reference numeral OUT1(1) represents a first stage external compensation control signal output terminal. The reference numeral OUT1(2) represents a second stage external compensation control signal output terminal. The reference numeral OUT1(3) represents a third stage external compensation control signal output terminal. The reference numeral OUT1(4) represents a fourth stage external compensation control signal output terminal. The reference numeral OUT1(5) represents a fifth stage external compensation control signal output terminal. The reference numeral OUT1(6) represents a sixth stage external compensation control signal output terminal.

As shown in FIG. 14, in the display period, each of the period of CLKE_1, the period of CLKE_2, the period of CLKE_3, the period of CLKE_4, the period of CLKE_5, and the period of CLKE_6 may be T, but not limited thereto.

Each of the duty cycle of CLKE_1, the duty cycle of CLKE_2, the duty cycle of CLKE_3, the duty cycle of CLKE_4, the duty cycle of CLKE_5 and the duty cycle of CLKE_6 may be ⅓, but not limited thereto.

CLKE_2 is delayed by T/6 from CLK3_1. CLKE_3 is delayed by T/6 from CLK3_2. CLKE_4 is delayed by T/6 from CLK3_3. CLKE_5 is delayed by T/6 from CLK3_4. CLKE_6 is delayed by T/6 from CLK3_5, but not limited to this.

In the embodiment of the present disclosure, STV is a start signal input to an input terminal of the first-stage gate driving unit included in the gate driving circuit. CLKA, CLKB, CLKD_N, CLKE_N, and CLKF_N are externally controlled clock signals. VDDo and VDDe are low frequency clock signals. Signal pulse width relationship of all the above signals is adjustable.

Further, in the embodiment of the present disclosure, the first external compensation clock signal CLKE_1 is coupled with a (6a−5)-th stage gate driving unit. The second external compensation clock signal CLKE_2 is coupled with a (6a−4)-th stage gate driving unit. The third external compensation clock signal CLKE_3 is coupled with a (6a−3)-th stage gate driving unit. The fourth external compensation clock signal CLKE_4 is coupled with a (6a−2)-th stage gate driving unit. The fifth external compensation clock signal CLKE_5 is coupled with a (6a−1)-th stage gate driving unit. The sixth external compensation clock signal CLKE_6 is coupled with a (6a)-th stage gate driving unit, where a is a positive integer.

In one embodiment of the present disclosure, the enabling signal input by the enabling terminal OE is a random signal generated by an external circuit.

In one embodiment of the present disclosure, VGL1<VGL2, that is, the potential at VGL2 is higher than the potential at VGL1 (in general, both VGL1 and VGL2 are negative voltages). VGL1 and VGL2 are DC low voltage signals, and their values may be the same or different. VDD is a DC high voltage signal.

A gate driving circuit according to one the embodiment of the present disclosure includes a plurality of stages of the above gate driving modules.

Specifically, the n-th stage gate driving module may include an N-th stage gate driving unit and a (N+1)-th stage gate driving unit.

In the n-th stage gate driving module, the input terminal is coupled with a (N−2)-th stage gate driving signal output terminal, and the reset terminal is coupled with a (N+4)-th stage gate driving signal output terminal, where n is a positive integer.

When the gate driving circuit according to one embodiment of the present disclosure is in operation, if one row pixel driving circuit needs to be externally compensated, then, in a corresponding row output phase (in the corresponding row output phase, the corresponding stage gate driving signal output terminal outputs an effective voltage) of the display period, the enabling terminal of the corresponding stage gate driving unit included in the gate driving circuit is controlled to input an effective voltage, so that the external compensation control signal output terminal of the corresponding stage gate driving unit outputs an effective voltage in the blank time period, thereby realizing random compensation.

In a specific implementation, the corresponding stage gate driving unit may be randomly compensated when the display panel shows poor display, thereby avoiding the sweep lines caused by the progressive compensation and the brightness deviation of the display panel.

Specifically, the N-th stage gate driving module includes an N-th stage gate driving unit and a (N+1)-th stage gate driving unit. The N-th stage gate driving unit may include a carry signal output terminal and a carry signal output circuit.

In an n-th stage gate driving module, the input terminal is coupled with a (N−2)-th stage carry signal output terminal, and the reset terminal is coupled with a (N+4)-th stage carry signal output terminal, where n is a positive integer.

The gate driving circuit according to one embodiment of the present disclosure is described hereinafter with an example in which the gate driving circuit includes a plurality of gate driving modules as shown in FIG. 13.

Figure 15:
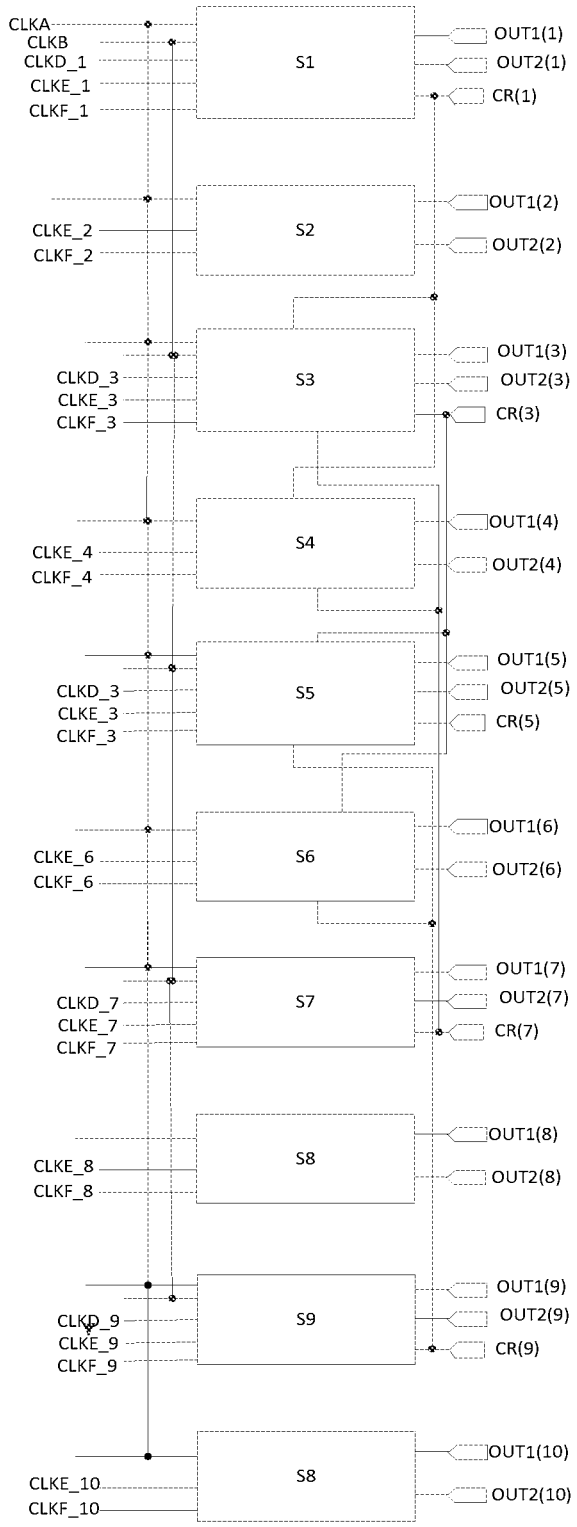
FIG. 15 is a block diagram of a gate driving circuit according to an embodiment of the present disclosure.

As shown in FIG. 15, a gate driving circuit according to one embodiment of the present disclosure includes a first gate driving module, a second gate driving module, a third gate driving module, a fourth gate driving module, and a fifth gate driving module. Each gate driving module has the same structure as the gate driving module shown in FIG. 13.

The first gate driving module includes a first stage gate driving unit S1 and a second stage gate driving unit S2.

The second gate driving module includes a third-stage gate driving unit S3 and a fourth-stage gate driving unit S4.

The third gate driving module includes a fifth-stage gate driving unit S5 and a sixth-stage gate driving unit S6.

The fourth gate driving module includes a seventh-stage gate driving unit S7 and an eighth-stage gate driving unit S8.

S1 includes a first-stage carry signal output terminal CR(1), a first-stage external compensation control signal output terminal OUT1(1), and a first-stage gate driving signal output terminal OUT2(1). S1 receives a first clock signal CLKA, a second clock signal CLKB, a first carry output clock signal CLKD_1, a first external compensation clock signal CLKE_1 and a first gate driving output clock signal CLKF_1.

S2 includes a second-stage external compensation control signal output terminal OUT1 (2) and a second-stage gate driving signal output terminal OUT2 (2). S2 receives the first clock signal CLKA, the second external compensation clock signal CLKE_2 and the second gate driving output clock signal CLKF_2.

S3 includes a third-stage carry signal output terminal CR(3), a third-stage external compensation control signal output terminal OUT1(3), and a third-stage gate driving signal output terminal OUT2(3). An input terminal of S3 is coupled with CR (1). A reset terminal of S3 is coupled with CR (7). S3 receives the first clock signal CLKA, the second clock signal CLKB, the third carry output clock signal CLKD_3, the third external compensation clock signal CLKE_3 and the third gate driving output clock signal CLKF_3.

S4 includes a fourth-stage external compensation control signal output terminal OUT1(4) and a fourth-stage gate driving signal output terminal OUT2(4). The input terminal of S4 is coupled with CR(1). The reset terminal of S4 is coupled with CR(7). S4 receives the first clock signal CLKA, the fourth external compensation clock signal CLKE_4, and the fourth gate driving output clock signal CLKF_4.

S5 includes a fifth-stage carry signal output terminal CR(5), a fifth-stage external compensation control signal output terminal OUT1(5), and a fifth-stage gate driving signal output terminal OUT2(5). An input terminal of S5 is coupled with CR(3). A reset terminal of S5 is coupled with CR(9). S5 receives the first clock signal CLKA, the second clock signal CLKB, the fifth carry output clock signal CLKD_5, the fifth external compensation clock signal CLKE_5, and the fifth gate driving output clock signal CLKF_5.

S6 includes a sixth-stage external compensation control signal output terminal OUT1(6) and a sixth-stage gate driving signal output terminal OUT2(6). An input terminal of S6 is coupled with CR(3). A reset terminal of S6 is coupled with CR(9). S6 receives the first clock signal CLKA, the sixth external compensation clock signal CLKE_6 and the sixth gate driving output clock signal CLKF_6.

S7 includes a seventh-stage carry signal output terminal CR(7), a seventh-stage external compensation control signal output terminal OUT1(7), and a seventh-stage gate driving signal output terminal OUT2(7). S7 receives the first clock signal CLKA, the second clock signal CLKB, a first carry output clock signal CLKD_1, a first external compensation clock signal CLKE_1 and a first gate driving output clock signal CLKF_1.

S8 includes an eighth-stage external compensation control signal output terminal OUT1(8) and an eighth-stage gate driving signal output terminal OUT2(8). S8 receives the first clock signal CLKA, the second external compensation clock signal CLKE_2, and the second gate driving output clock signal CLKF_2.

S9 includes a ninth-stage carry signal output terminal CR(9), a ninth-stage external compensation control signal output terminal OUT1(9) and a ninth-stage gate driving signal output terminal OUT2(9). S9 receives the first clock signal CLKA, the second clock signal CLKB, a third carry output clock signal CLKD_3, a third external compensation clock signal CLKE_3, and a third gate driving output clock signal CLKF_3.

S10 includes a tenth-stage external compensation control signal output terminal OUT1(10) and a tenth-stage gate driving signal output terminal OUT2(10). S10 receives the first clock signal CLKA, the fourth external compensation clock signal CLKE_4, and the fourth gate driving output clock signal CLKF_4.

The following takes the working process of S3 and S4 in a display period as an example for illustration.

In this display period, VDDo is high level, and VDDe is low level.

In a third row input phase included in the display period, CR(1) outputs a high voltage, CR(7) outputs a low voltage, each of CLKA, CLKE_3, CLKD_3, and CLKF_3 is a low voltage, and both CLKE_4 and CLKF_4 are low voltages, thereby controlling each of a potential at Q(3) and a potential at Q(4) to be high level, and each of a potential at QB(3) and a potential at QB(4) to be low level, each of CR(3), OUT1(3) and OUT2(3) outputting a low voltage, and each of OUT1(4) and OUT2(4) outputting a low voltage.

In a third row output phase included in the display period, each of the potential at Q(3) and the potential at Q(4) is high level, each of the potential at QB(3) and the potential at QB(4) is low level, each of CLKE_3, CLKD_3 and CLKF_3 is a high voltage, and each of CR(3), OUT1(3) and OUT2(3) outputs a high voltage.

In a fourth row output phase included in the display period, each of the potential at Q(3) and the potential at Q(4) is high level, each of the potential at QB(3) and the potential at QB(4) is low level, each of CLKE_4 and CLKF_4 is a high voltage, and each of OUT1(4) and OUT2(4) outputs a high voltage.

In a third hold phase between the third row output phase and the third row reset phase, the potential at Q(3) is maintained by a first storage capacitor and a second storage capacitor included in S(3) to be high level and low level; but since each of CLKE_3, CLKD_3 and CLKF_3 is a low voltage, each of CR(3), OUT1(3) and OUT2(3) outputs a low voltage.

In a fourth hold phase between the fourth row output phase and the fourth row reset phase, the potential at Q(4) is maintained by a first storage capacitor and a second storage capacitor included in S4 to be high level and low level; but since each of CLKE_4 and CLKF_4 is a low voltage, each of OUT1(4) and OUT2(4) outputs a low voltage.

In the third row reset phase (which is also the fourth row reset phase) included in the display period, each of the potential at Q(3) and the potential at Q(4) is low level, the potential at Q(3) is high level, and each of CR(3), OUT1(3), OUT2(3), OUT1(4) and OUT2(4) outputs a low voltage.

The display of all the row pixel circuits is completed by sequentially shifting, and then the blank time period starts.

A display device according to one embodiment of the present disclosure includes the above gate driving circuit.

The display device provided in the embodiment of the present disclosure may be any product or component having a display function, such as a mobile phone, a tablet computer, a television, a monitor, a notebook computer, a digital photo frame, and a navigator.

The above are merely the optional embodiments of the present disclosure. It should be noted that, a person skilled in the art may make improvements and modifications without departing from the principle of the present disclosure, and these improvements and modifications shall also fall within the scope of the present disclosure.

What is claimed is:

1. A gate driving unit, comprising: an external compensation control signal output terminal, a gate driving signal output terminal, an external compensation control signal output circuit, a gate driving signal output circuit, a pull-up control circuit and a pull-down node control circuit;

wherein the pull-up control circuit is configured to, under control of an enabling signal input by an enabling terminal and a current-stage driving signal, control a potential at a first node; under control of the potential at the first node, a first clock signal input by a first clock signal terminal, a second clock signal input by a second clock signal terminal and a potential at a pull-down node, control a potential at a pull-up control node; under control of the potential at the pull-up control node, control a potential at a pull-up node, thereby controlling the potential at the pull-up node to be an effective voltage in a preset time period of a blank time period;

the pull-down node control circuit is configured to control the potential at the pull-down node;

the external compensation control signal output circuit is configured to, under control of the potential at the pull-up node, control the external compensation control signal output terminal to be coupled with an external compensation clock signal terminal; under control of the potential at the pull-down node, control the external compensation control signal output terminal to be coupled with a first voltage terminal;

the gate driving signal output circuit is configured to, under control of the potential at the pull-up node and the potential at the pull-down node, control the gate driving signal output terminal to output a gate driving signal.

2. The gate driving unit according to claim 1, wherein waveform of the current-stage driving signal is the same as waveform of the gate driving signal.

3. The gate driving unit according to claim 1, wherein the pull-up control circuit includes a first node control sub-circuit, a second node control sub-circuit, a third node control sub-circuit, a pull-up control node control sub-circuit and a pull-up control sub-circuit;

the first node control sub-circuit is configured to, under control of the enabling signal, control the first node to receive the current-stage driving signal, and control to maintain the potential at the first node;

the second node control sub-circuit is configured to, under control of the second clock signal, control a potential at a second node;

the third node control sub-circuit is configured to, under control of the potential at the second node, control a third node to be coupled with a second voltage terminal;

the pull-up control node control sub-circuit is configured to, under control of the potential at the first node, control the pull-up control node to be coupled with the first clock signal terminal; and, under control of the potential at the pull-down node, control the pull-up control node to be coupled with the third node;

the pull-up control sub-circuit is configured to, under control of the potential at the pull-up control node, control the pull-up node to be coupled with a third voltage terminal.

4. The gate driving unit according to claim 3, wherein the second node control sub-circuit is further configured to, under control of the first clock signal, control the second node to be coupled with the second voltage terminal.

5. The gate driving unit according to claim 3, wherein the first node control sub-circuit includes a first control transistor and a storage capacitor;

a control electrode of the first control transistor is coupled with the enabling terminal; a first electrode of the first control transistor receives the current-stage driving signal; a second electrode of the first control transistor is coupled with the first node;

a first terminal of the storage capacitor is coupled with the first node; a second terminal of the storage capacitor is coupled with the pull-up control node.

6. The gate driving unit according to claim 3, wherein the second node control sub-circuit includes a second control transistor;

a control electrode of the second control transistor and a first electrode of the second control transistor are coupled with the second clock signal terminal; a second electrode of the second control transistor is coupled with the second node.

7. The gate driving unit according to claim 6, wherein the second node control sub-circuit further includes a second node reset transistor;

a control electrode of the second node reset transistor is coupled with the first clock signal terminal; a first electrode of the second node reset transistor is coupled with the second node; a second electrode of the second node reset transistor is coupled with the second voltage terminal.

8. The gate driving unit according to claim 3, wherein the third node control sub-circuit includes a third control transistor;

a control electrode of the third control transistor is coupled with the second node; a first electrode of the third control transistor is coupled with the third node; a second electrode of the third control transistor is coupled with the second voltage terminal;

the pull-up control node control sub-circuit includes a fourth control transistor and a fifth control transistor;

a control electrode of the fourth control transistor is coupled with the first node; a first electrode of the fourth control transistor is coupled with the first clock signal terminal; a second electrode of the fourth control transistor is coupled with the pull-up control node;

a control electrode of the fifth control transistor is coupled with the pull-down node;

a first electrode of the fifth control transistor is coupled with the pull-up control node; a second electrode of the fifth control transistor is coupled with the third node;

the pull-up control sub-circuit includes a pull-up control transistor;

a control electrode of the pull-up control transistor is coupled with the pull-up control node; a first electrode of the pull-up control transistor is coupled with the pull-up node; a second electrode of the pull-up control transistor is coupled with the third voltage terminal.

9. The gate driving unit according to claim 3, wherein the pull-down node control circuit is coupled with a first control voltage terminal, the pull-up node, the pull-down node, the first node, the first clock signal terminal, the input terminal and a fifth voltage terminal, respectively; the pull-down node control circuit is configured to, under control of a first control voltage input by the first control voltage terminal and the potential at the pull-up node, control the potential at the pull-down node; under control of the potential at the first node and the first clock signal, control the pull-down node to be coupled with the fifth voltage terminal; under control of the input signal input by the input terminal, control the pull-down node to be coupled with the filth voltage terminal.

10. The gate driving unit according to claim 9, wherein the pull-down node control circuit includes a first pull-down control transistor, a second pull-down control transistor, a third pull-down control transistor, a fourth pull-down control transistor and a fifth pull-down control transistor;

a control electrode of the first pull-down control transistor and a first electrode of the first pull-down control transistor are both coupled with the first control voltage terminal; a second electrode of the first pull-down control transistor is coupled with the pull-down node;

a control electrode of the second pull-down control transistor is coupled with the pull-up node; a first electrode of the second pull-down control transistor is coupled with the pull-down node; a second electrode of the second pull-down control transistor is coupled with the fifth voltage terminal;

a control electrode of the third pull-down control transistor is coupled with the first clock signal terminal; a first electrode of the third pull-down control transistor is coupled with the pull-down node;

a control electrode of the fourth pull-down control transistor is coupled with the first node; a first electrode of the fourth pull-down control transistor is coupled with a second electrode of the third pull-down control transistor; a second electrode of the fourth pull-down control transistor is coupled with the fifth voltage terminal;

a control electrode of the fifth pull-down control transistor is coupled with the input terminal; a first electrode of the fifth pull-down control transistor is coupled with the pull-down node; a second electrode of the fifth pull-down control transistor is coupled with the fifth voltage terminal.

11. The gate driving unit according to claim 1, wherein the gate driving unit further includes a pull-up node control circuit;

the pull-up node control circuit is coupled with an input terminal, a reset terminal, the pull-up node, the pull-down node, a blank period reset terminal, a third voltage terminal and a fourth voltage terminal, respectively; the pull-up node control circuit is configured to, under control of an input signal input by the input terminal, control the pull-up node to be coupled with the third voltage terminal; under control of a reset signal input by the reset terminal, control the pull-up node to be coupled with the fourth voltage terminal; under control of a blank period reset signal input by the blank period reset terminal, control the pull-up node to be coupled with the fourth voltage terminal; under control of the potential at the pull-down node, control the pull-up node to be coupled with the fourth voltage terminal, and maintain the potential at the pull-up node.

12. The gate driving unit according to claim 11, wherein the pull-up node control circuit includes a first pull-up node control transistor, a second pull-up node control transistor, a third pull-up node control transistor, a fourth pull-up node control transistor, a first storage capacitor and a second storage capacitor;

a control electrode of the first pull-up node control transistor is coupled with the input terminal; a first electrode of the first pull-up node control transistor is coupled with the third voltage terminal; a second electrode of the first pull-up node control transistor is coupled with the pull-up node;

a control electrode of the second pull-up node control transistor is coupled with the reset terminal; a first electrode of the second pull-up node control transistor is coupled with the pull-up node; a second electrode of the second pull-up node control transistor is coupled with the fourth voltage terminal;

a control electrode of the third pull-up node control transistor is coupled with the blank period reset terminal; a first electrode of the third pull-up node control transistor is coupled with the pull-up node; a second electrode of the third pull-up node control transistor is coupled with the fourth voltage terminal;

a control electrode of the fourth pull-up node control transistor is coupled with the pull-down node; a first electrode of the fourth pull-up node control transistor is coupled with the pull-up node; a second electrode of the fourth pull-up node control transistor is coupled with the fourth voltage terminal;

a first terminal of the first storage capacitor is coupled with the pull-up node; a second terminal of the first storage capacitor is coupled with the external compensation control signal output terminal;

a first terminal of the second storage capacitor is coupled with the pull-up node; a second terminal of the second storage capacitor is coupled with the gate driving signal output terminal.

13. The gate driving unit according to claim 1, wherein the external compensation control signal output circuit includes a first compensation output transistor and a second compensation output transistor;

a control electrode of the first compensation output transistor is coupled with the pull-up node; a first electrode of the first compensation output transistor is coupled with the external compensation clock signal terminal; a second electrode of the first compensation output transistor is coupled with the external compensation control signal output terminal;

a control electrode of the second compensation output transistor is coupled with the pull-down node; a first electrode of the second compensation output transistor is coupled with the external compensation control signal output terminal; a second electrode of the second compensation output transistor is coupled with the first voltage terminal.

14. The gate driving unit according to claim 1, wherein the gate driving unit further includes a carry signal output terminal and a carry signal output circuit;

the carry signal output circuit is configured to, under control of the potential at the pull-up node and the potential at the pull-down node, control the carry signal output terminal to output a carry signal;

the current-stage, driving signal is a carry signal provided by the carry signal output terminal.

15. A gate driving module, comprising: the gate driving unit according to claim 1; wherein the gate driving unit is an N-th stage gate driving unit, N is a positive integer; the gate driving module further includes a (N+1)-th stage gate driving unit;

a pull-up node in the (N+1)-th stage gate driving unit is a (N+1)-th pull-up node; a pull-down node in the (N+1)-th gate driving unit is a (N+1)-th pull-down node; a pull-up control node in the (N+1)-th gate driving unit is a pull-up control node in the N-th stage gate driving unit;

the (N+1)-th gate driving unit includes a (N+1)-th stage pull-up control circuit, a (N+1)-th stage external compensation control signal output terminal, a (N+1)-th stage gate driving signal output terminal, a (N+1)-th stage external compensation control signal output circuit, a (N+1)-th stage gate driving signal output circuit, and a (N+1)-th stage pull-down node control circuit;

the (N+1)-th stage pull-up control circuit is coupled with the N-th pull-up control node, and is configured to, under control of a potential at the N-th pull-up control node, control the (N+1)-th pull-up node to be coupled with a third voltage terminal;

the (N+1)-th stage pull-down node control circuit is configured to control a potential at the (N+1)-th pull-down node;

the (N+1)-th stage external compensation control signal output circuit is configured to, under control of the potential at the (N+1)-th pull-up node, control the (N+1)-th stage external compensation control signal output terminal to be coupled with the second external compensation clock signal terminal; under control of the potential at the (N+1)-th pull-down node, control the external compensation control signal output terminal to be coupled with a first voltage terminal;

the (N+1)-th stage gate driving signal output circuit is configured to, under control of the potential at the (N+1)-th pull-up node and the potential at the (N+1)-th pull-down node, control the (N+1)-th stage gate driving signal output terminal to output a gate driving signal.

16. The gate driving module according to claim 15, wherein the (N+1)-th stage gate driving unit further includes a (N+1)-th pull-up node control circuit;

the (N+1)-th pull-up node control circuit is coupled with an input terminal, a reset terminal, the (N+1)-th pull-up node, the (N+1)-th pull-down node, a blank period reset terminal, a third voltage terminal and a fourth voltage terminal, respectively; the (N+1)-th pull-up node control circuit is configured to, under control of an input signal input by the input terminal, control the (N+1)-th pull-up node to be coupled with the third voltage terminal; under control of a reset signal input by the reset terminal, control the (N+1)-th pull-up node to be coupled with the fourth voltage terminal; under control of a blank period reset signal input by the blank period reset terminal, control the (N+1)-th pull-up node to be coupled with the fourth voltage terminal; under control of the potential at the (N+1)-th pull-down node, control the (N+1)-th pull-up node to be coupled with the fourth voltage terminal, and maintain the potential at the (N+1)-th pull-up node.

17. The gate driving module according to claim 15, wherein the pull-up control circuit in the N-th stage gate driving unit is an N-th pull-up control circuit; the N-th pull-up control circuit includes a first node control sub-circuit, a second node control sub-circuit, a third node control sub-circuit, a pull-up control node control sub-circuit and a pull-up control sub-circuit;

the (N+1)-th pull-down node control circuit is coupled with a second control voltage terminal, the (N+1)-th pull-up node, the (N+1)-th pull-down node, the first node in the N-th stage gate driving unit, the first clock signal terminal, the reset terminal and a fifth voltage terminal, respectively; the (N+1)-th pull-down node control circuit is configured to, under control of a second control voltage input by the second control voltage terminal and the potential at the (N+1)-th pull-up node, control a potential at the (N+1)-th pull-down node: under control of the potential at the first node and a first clock signal input by the first clock signal terminal, control the (N+1)-th pull-down node to be coupled with the fifth voltage terminal; under control of the input signal input by the input terminal, control the pull-down node to be coupled with the fifth voltage terminal.

18. The gate driving module according to claim 17, wherein the external compensation control signal output circuit in the N-th stage gate driving unit is an N-th external compensation control signal output circuit; the gate driving signal output circuit in the N-th stage gate driving unit is the N-th gate driving signal output circuit; the external compensation control signal output terminal in the N-th stage gate driving unit is an N-th stage external compensation control signal output terminal; the gate driving signal output terminal in the N-th stage gate driving unit is the N-th stage gate driving signal output terminal; the pull-up node in the N-th stage gate driving unit is an N-th pull-up node; the pull-down node in the N-th stage gate driving unit is an N-th pull-down node;

the N-th external compensation control signal output circuit is further coupled with the (N+1)-th pull-down node, and is configured to, under control of a potential at the (N+1)-th pull-down node, reset the N-th external compensation control signal output terminal;

the N-th gate driving signal output circuit is further coupled with the (N+1)-th pull-down node, and is configured to, under control of a potential at the (N+1)-th pull-down node, reset the N-th gate driving signal output terminal;

the (N+1)-th external compensation control signal output circuit is further coupled with the N-th pull-down node, and is configured to, under control of a potential at the N-th pull-down node, reset the (N+1)-th stage external compensation control signal output terminal;

the (N+1)-th gate driving signal output circuit is further coupled with the N-th pull-down node, and is configured to, under control of the potential at the N-th pull-down node, reset the (N+1)-th stage gate driving signal output terminal.

19. A gate driving circuit comprising a plurality of stages of gate driving modules according to claim 15.

20. The gate driving circuit according to claim 19, wherein an n-th stage gate driving module includes an N-th stage gate driving unit and a (N+1)-th stage gate driving unit;

in the n-th stage gate driving module, an input terminal is coupled with a (N−2)-th stage gate driving signal output terminal, and a reset terminal is coupled with a (N+4)-th stage gate driving signal output terminal, wherein n is a positive integer; or, the N-th stage gate driving unit includes a carry signal output terminal and a carry signal output circuit: the n-th stage gate driving module includes an N-th stage gate driving unit and a (N+1)-th stage gate driving unit in the n-th stage gate driving module, an input terminal is coupled with a (N−2)-th stage carry signal output terminal, and a reset terminal is coupled with a (N+4)-th stage carry signal output terminal, wherein n is a positive integer.

* * * * *